US007857418B2

(12) United States Patent
Matsuhashi et al.

(10) Patent No.: US 7,857,418 B2
(45) Date of Patent: Dec. 28, 2010

(54) MAINTENANCE SHEET AND LIQUID EJECTING APPARATUS

(75) Inventors: Kunihiko Matsuhashi, Matsumoto (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 873 days.

(21) Appl. No.: 11/758,517

(22) Filed: Jun. 5, 2007

(65) Prior Publication Data

US 2007/0279450 A1 Dec. 6, 2007

(30) Foreign Application Priority Data

Jun. 5, 2006 (JP) ..... 2006-156117
Jun. 5, 2006 (JP) ..... 2006-156118
Apr. 20, 2007 (JP) ..... 2007-111650
Apr. 20, 2007 (JP) ..... 2007-111651

(51) Int. Cl.
*B41J 2/165* (2006.01)
*B41J 23/00* (2006.01)
*B41J 2/155* (2006.01)

(52) U.S. Cl. ..... 347/32; 347/20; 347/22; 347/23; 347/29; 347/30; 347/33; 347/36; 347/42

(58) Field of Classification Search ..... 347/22, 347/29, 30, 31, 32, 33, 36
See application file for complete search history.

(56) References Cited

U.S. PATENT DOCUMENTS 5,166,707 A * 11/1992 Watanabe et al. ..... 347/3
5,471,230 A * 11/1995 Saito et al. ..... 347/29
5,481,283 A * 1/1996 Watanabe et al. ..... 347/33
6,203,136 B1 * 3/2001 Takahashi et al. ..... 347/32
6,273,546 B1 * 8/2001 Kobayashi et al. ..... 347/29
6,286,931 B1 * 9/2001 Kawakami et al. ..... 347/32
7,040,734 B2 * 5/2006 Nakashima et al. ..... 347/33
7,334,862 B2 * 2/2008 Kachi ..... 347/22
2001/0021330 A1 * 9/2001 Kishida et al. ..... 400/55

FOREIGN PATENT DOCUMENTS

JP 2002-192737 7/2002
JP 2005-053119 3/2005

* cited by examiner

*Primary Examiner*—Ryan Lepisto
(74) *Attorney, Agent, or Firm*—Workman Nydegger

(57) ABSTRACT

A maintenance sheet with a facing surface facing a nozzle formation surface of a liquid ejection head provided in a liquid ejecting apparatus is provided. The maintenance sheet includes a cap section that is brought into abutment with the nozzle formation surface to form a sealed space in cooperation with the nozzle formation surface when the facing surface and the nozzle formation surface have been made to approach each other relatively in a facing position where the facing surface faces the nozzle formation surface, and that is made variable in internal volume in the abutment state, a communication hole that is penetratingly formed so as to allow the inside and outside of the cap section to communicate with each other, and a valve that opens and closes the communication hole. The valve activates to open with a reduction in the internal volume of the cap section, while the valve activates to close with an increase in the internal volume of the cap section.

13 Claims, 12 Drawing Sheets

MAINTENANCE SHEET AND LIQUID EJECTING APPARATUS

CROSS-REFERENCE TO RELATED APPLICATIONS

The present application claims priority to Japanese Patent Application Nos. 2006-156117, filed Jun. 5, 2006, 2006-156118, filed Jun. 5, 2006, 2007-111650, filed Apr. 20, 2007, and 2007-111651, filed Apr. 20, 2007, the whole contents of which are hereby incorporated by reference into the present application.

BACKGROUND

1. Technical Field

The present invention relates to a maintenance sheet and a liquid ejecting apparatus.

2. Related Art

A full-line ink jet printer (hereinafter simply referred to as "printer") serving as an ink jet printer (liquid ejecting apparatus) for performing printing on a recording sheet serving as a target at high speed has been suggested. In this kind of printer, there is a possibility that a rise in ink viscosity or solidification caused by evaporation of an ink solvent from nozzles of a recording head serving as a liquid ejection head, adhesion of dust, and clogging of a nozzle caused by entrainment of bubbles may occur. There is also a possibility that the ink discharged from a nozzle of the recording head may adhere and solidify in the vicinity of a nozzle opening of a nozzle formation surface due to rebounding from a recording sheet, etc., or deviation of the direction of discharge of ink from a nozzle, and clogging of a nozzle may be caused. Therefore, in such a printer, as maintenance for suppressing clogging of a nozzle of the recording head, capping of bringing a cap member into abutment with the nozzle formation surface so as to surround the nozzle opening of the nozzle formation surface, and wiping of the nozzle formation surface by a wiper member are executed appropriately.

That is, in a printer described in JP-A-2005-53119, a maintenance sheet (hereinafter referred to as "first related-art maintenance sheet") that is brought into abutment with a nozzle formation surface of a recording head and thereby allowed to perform capping is used, and the first related-art maintenance sheet is transported by a sheet transport mechanism from a non-maintenance position where the abutment of the nozzle formation surface of the recording head is not allowed to a maintenance position where the abutment is allowed. Also, the first related-art maintenance sheet is pushed against the nozzle formation surface of the recording head by urging the first related-art maintenance sheet transported to the maintenance position upward. Accordingly, according to this configuration, the capping operation of capping the nozzle formation surface by the cap member is allowed without moving the recording head towards a non-printing region from a printing position.

Further, in a printer described in JP-A-2002-192737, a wiping sheet (hereinafter referred to as "second related-art maintenance sheet") that can wipe a nozzle formation surface of a recording head is used to perform wiping. That is, a wiper section composed of a number of thin hairs is formed in the second related-art maintenance sheet. Also, at least one of the second related-art maintenance sheet and a recording head in a passing-each-other direction in a state where sliding contact between the tip of the wiper section and the nozzle formation surface of the recording head is maintained is moved relative to each other, thereby wiping adhering matter, such as ink and dust, adhering to the nozzle formation surface of the recording head.

Meanwhile, although the first related-art maintenance sheet used for the printer described in JP-A-2005-53119 has a function of capping the nozzle formation surface of the recording head, it does not have other maintenance functions (function of wiping the nozzle formation surface, etc.). Also, although the second related-art maintenance sheet used for the printer described in JP-A-2002-192737 has a function of wiping the nozzle formation surface of the recording head, it does not have other maintenance functions (a function of capping the nozzle formation surface, etc.). Accordingly, when execution of a plurality of kinds of maintenance (for example, capping and wiping) is attempted in each of the printers described in the JP-A-2005-53119 and JP-A-2002-192737, both the first related-art maintenance sheet and the second related art maintenance sheet may be selectively used, if required, in each printer.

However, in this case, it is necessary to transport the first related-art maintenance sheet to the maintenance position when the nozzle formation surface of the recording head is to be capped. On the other hand, it is necessary to transport the second related-art maintenance sheet to the maintenance sheet when the nozzle formation surface is to be wiped. That is, there are problems in that it is necessary to perform a complicated control of selecting and transporting any one of various maintenance sheets if required, and when various kinds of maintenance are performed continuously, the control thereof becomes complicated, and consequently various kinds of maintenance cannot be executed efficiently.

Further, each of the above related-art maintenance sheets is not provided with a configuration that allows execution of so-called cleaning that sucks ink from the inside of a nozzle of the recording head. Therefore, for example, even if a printer is equipped with the related art maintenance sheets, there is a problem in that a cleaning device having a suction pump, etc. should be provided separately from the related-art maintenance sheets.

SUMMARY

An advantage of some aspects of the invention is that it provides a maintenance sheet that makes it possible to execute efficiently a plurality of kinds of maintenance in a liquid ejection head, and a liquid ejecting apparatus that makes it possible to easily achieve maintenance of the liquid ejection head, using the maintenance sheet, without increasing the size of the whole apparatus.

In a first aspect of the invention, a maintenance sheet with a facing surface facing a nozzle formation surface of a liquid ejection head provided in a liquid ejecting apparatus is provided. The maintenance sheet includes a cap section, a communication hole that is penetratingly formed so as to allow the inside and outside of the cap section to communicate with each other, and a valve that opens and closes the communication hole. The cap section is brought into abutment with the nozzle formation surface to form a sealed space in cooperation with the nozzle formation surface when the facing surface and the nozzle formation surface have been made to approach each other relatively in a facing position where the facing surface faces the nozzle formation surface, and is made variable in internal volume in the abutment state. The valve activates to open with a reduction in the internal volume of the cap section, while the valve activates to close with an increase in the internal volume of the cap section.

According to this configuration, when the facing surface of the maintenance sheet disposed in the facing position and the nozzle formation surface of the liquid ejection head have been made to approach each other relatively, the cap section provided in the maintenance sheet is brought into abutment with the nozzle formation surface to form a sealed space in cooperation with the nozzle formation surface. Moreover, when the internal volume of the cap section is reduced while this state is maintained, the pressure within the cap section becomes higher than the outside of the cap section. As a result, the valve activates to open. At this time, when the liquid ejected into the cap section from the liquid ejection head is stored, this liquid is discharged to the outside of the cap section via the communication hole. Moreover, when the internal volume of the cap section has been increased while the abutment between maintenance sheet and the nozzle formation surface is maintained, the valve is open at this time, and the pressure within the cap section becomes lower than the outside of the cap section, thereby forming a negative pressure state. As a result, liquid is sucked into the cap section from the liquid ejection head. That is, cleaning is executed. On the other hand, when the internal volume within the cap section is made not to change in a case where the cap section has been brought into abutment with the nozzle formation surface of the liquid ejection head, the nozzle formation surface will be capped by the cap section. Accordingly, the maintenance sheet of the first aspect of the invention is able to cap the nozzle formation surface and also perform cleaning by bringing the cap section and the nozzle formation surface of the liquid ejection head into abutment with each other.

Preferably, the maintenance sheet according to the first aspect of the invention further include a wiper section that wipes the nozzle formation surface when the facing surface and the nozzle formation surface have been moved relative to each other in a direction parallel to the nozzle formation surface in the facing position.

According to this configuration, the maintenance sheet is provided with not only the cap section for capping the nozzle formation surface of the liquid ejection head, but also the wiper section for wiping the nozzle formation surface. Therefore, unlike a related-art maintenance sheet, it is not necessary to use a plurality of kinds of maintenance sheets selectively according to the kind of maintenance to execute. Accordingly, a plurality of kinds of maintenance in the recording head can be efficiently executed with one maintenance sheet.

In the maintenance sheet according to the first aspect of the invention, preferably, the wiper section is formed such that the projection height thereof from the facing surface becomes larger than the projection height of the cap section from the facing surface in a case where the internal volume of the cap section reaches a maximum. Supposing that the projection height of the wiper section from the facing surface is smaller than the projection height of the cap section from the facing surface in a case where the internal volume of the cap section reaches a maximum, when the nozzle formation surface is wiped subsequent to cleaning, the nozzle formation surface will be wiped after at least one of the liquid ejection head and the maintenance sheet is moved in a direction in which the nozzle formation surface and the facing surface are made to approach each other relatively. However, according to the first aspect of the invention, wiping of the nozzle formation surface is performed when the maintenance sheet is transported in the transport direction, without moving at least one of the liquid ejection head and the maintenance sheet in a direction in which the nozzle formation surface and the facing surface are made to approach each other relatively. Accordingly, cleaning, and the wiping of the nozzle formation surface can be performed continuously and efficiently.

In the maintenance sheet according the first aspect of the invention, preferably, a projection is formed at the edge on the facing surface so as to surround the cap section and the wiper section, and the wiper section is formed such that the projection height thereof from the facing surface is smaller than the projection height of the projection from the facing surface.

According to this configuration, when a plurality of maintenance sheets are accommodated in a stacked state, the projection of one maintenance sheet will abut on another maintenance sheet. Therefore, for example, when maintenance sheets are accommodated in a stacked state, the wiper section and the wiper section are inhibited from inadvertently abutting on another maintenance sheet 16, etc., and consequently, the wiper section can be inhibited from being damaged.

Preferably, the maintenance sheet according to the first aspect of the invention further includes a liquid accommodating section that accommodates liquid ejected as a waste liquid onto the facing surface from liquid ejection nozzles of the liquid ejection head in the facing position.

According to this configuration, the liquid that is ejected as a waste liquid from the liquid ejection head by flushing can be accommodated in the liquid accommodating section.

In the maintenance sheet according to the first aspect of the invention, preferably, the cap section, the wiper section, and the liquid accommodating section are arranged so as to extend along a predetermined direction as a transport direction of the maintenance sheet on the facing surface, and such that the wiper section is located between the cap section and the liquid accommodating section.

According to this configuration, when the maintenance sheet is transported in the transport direction after cleaning is executed by the cap section, wiping of the nozzle formation surface is performed by bringing the tip of the wiper section into sliding contact with the nozzle formation surface of the liquid ejection head. That is, cleaning, and the wiping of the nozzle formation surface can be performed continuously and rapidly. Further, since the ink accommodating section is not disposed between the cap section and the wiper section, the ink accommodating section can be inhibited from becoming a hindrance when cleaning, and the wiping of the nozzle formation surface are performed continuously and rapidly.

Preferably, the maintenance sheet according to the first aspect of the invention further includes a biasing member that biases an opening end of the cap section open to the nozzle formation surface towards the nozzle formation surface so as to allow abutment of the nozzle formation surface on the cap section in the facing position.

According to this configuration, when the nozzle formation surface of the liquid ejection head and the cap section have been moved relative to each other in a direction away from each other in a state where the nozzle formation surface of the liquid ejection head, and the cap section are brought into abutment with each other to form a sealed space within the cap section, the opening end of the cap section open to the nozzle formation surface is biased towards the nozzle formation surface by the biasing member. Therefore, even if the internal volume of the cap section is increased, thereby making the pressure within the cap section into a negative pressure state, the abutment between the cap section and the nozzle formation surface is maintained well. Accordingly, cleaning by the maintenance sheet is certainly executed by securing the sealing performance of a sealed space formed by the cap section and the nozzle formation surface.

Preferably, the maintenance sheet according to the first aspect of the invention further includes an separate cap section different from the cap section, and a communicating section that allows the inside and outside of the separate cap section to always communicate with each other, and the separate cap section is configured such that it is brought into abutment with the nozzle formation surface to form a sealed space in cooperation with the nozzle formation surface, when the facing surface and the nozzle formation surface have been made to approach each other relatively in the facing position.

According to this configuration, since an separate cap section is provided in the maintenance sheet separately from the cap section, it is not necessary to performing cleaning, and when only capping of the nozzle formation surface is tried to execute, the addition cap section is brought into abutment with the nozzle formation surface. In this state, for example, when the temperature of an atmosphere in which a maintenance sheet is installed has changed, there is a probability that the pressure within the separate cap section may change with the change of the atmospheric temperature. However, since the inside of the separate cap section always communicates with the outside of the separate cap section via the communicating section, a pressure difference is inhibited from being caused between the internal pressure and external pressure of the cap section. Accordingly, unlike a case where any communicating section is not formed, a meniscus within a liquid ejection nozzle of the liquid ejection head is inhibited from being broken.

In a second aspect of the invention, a liquid ejection apparatus including a liquid ejection head that ejects liquid to a target from liquid ejection nozzles, a sheet transport mechanism, a relative movement mechanism, and a control unit is provided. The sheet transport mechanism transports the maintenance sheet according to the first aspect of the invention to the facing position from a non-facing position where the facing surface does not face the nozzle formation surface of the liquid ejection head. The relative movement mechanism moves relative to at least one of the maintenance sheets transported to the facing position by the sheet transport mechanism and the liquid ejection head, in a direction in which the facing surface and the nozzle formation surface approach each other and separate from each other. The control unit controls the relative movement mechanism and the sheet transport mechanism.

According to this configuration, by using the maintenance sheet provided with the cap section with a suction function in a liquid ejection printer including the sheet transport mechanism and the relative movement mechanism, cleaning can be executed easily. Further, since it is not necessary to provide, for example, a cleaning mechanism having a suction pump, etc., the size of the liquid ejection apparatus itself can be inhibited from increasing.

In the liquid ejecting apparatus according to the second aspect of the invention, preferably, the control unit controls the relative movement mechanism such that the internal volume of the cap section increases after the internal volume of the cap section decreases, when liquid is sucked from the liquid ejection nozzles into the cap section of the maintenance sheet in abutment with the nozzle formation surface of the liquid ejection head in the facing position.

According to this configuration, as the relative movement mechanism is driven such that the facing surface of the maintenance sheet and the nozzle formation surface move relative to each other in a direction in which they approach each other and separate from each other while the cap section is brought into abutment with the nozzle formation surface of the liquid ejection head, cleaning is executed. Accordingly, cleaning can be easily executed using the maintenance sheet.

In the liquid ejecting apparatus according to the second aspect of the invention, preferably, the control unit controls the relative movement mechanism such that the internal volume of the cap section with the increased internal volume decreases, when liquid is discharged to the outside of the cap section after the liquid is sucked from the liquid ejection nozzles into the cap section of the maintenance sheet in abutment with the nozzle formation surface of the liquid ejection head in the facing position.

According to this configuration, as the relative movement mechanism is driven such that the facing surface of the maintenance sheet and the nozzle formation surface move relative to each other in a direction in which they approach each other and separate from each other in a state where the cap section and the nozzle formation surface of the liquid ejection head are brought into abutment each other, the internal volume within the cap section decreases and thereby the valve opens. As a result, when liquid is stored within the cap section, this liquid is discharged to the outside of the cap section via the communication hole.

Preferably, the liquid ejecting apparatus according to the second aspect of the invention further includes a sealed state releasing mechanism that releases a sealed state within the cap section when the cap section and the nozzle formation surface have been brought into abutment with each other to form a sealed space within the cap section. The control unit controls the sealed state releasing mechanism such that the internal volume of the cap section decreases when the cap section of the maintenance sheet in abutment with the nozzle formation surface of the liquid ejection head in the facing position is separated from the nozzle formation surface. Then, the control unit controls the relative movement mechanism, thereby releasing the sealed state within the cap section. Then, the control unit controls the relative movement mechanism such that the facing surface of the maintenance sheet, and the nozzle formation surface of the liquid ejection head are separated from each other.

According to this configuration, when the cap section and the nozzle formation surface of the liquid ejection head are brought into abutment with each other to form a sealed space within the cap section, the sealed state within the cap section is released by the sealed state releasing mechanism, and then the facing surface of the maintenance sheet and the nozzle formation surface of the liquid ejection head are relatively separated from each other by the relative movement mechanism. Therefore, since the sealed state within the cap section is released when the facing surface of the maintenance sheet and the nozzle formation surface of the liquid ejection head are relatively separated from each other, the suction by the cap section can be inhibited from inadvertently acting on the liquid ejection head. That is, cleaning can be inhibited from being executed inadvertently.

In the liquid ejecting apparatus according to the second aspect of the invention, preferably, the sealed state releasing mechanism moves relative to at least one of the maintenance sheets and the liquid ejection head in a direction that intersects the direction in which the facing surface and the nozzle formation surface approach each other and separate from each other, thereby releasing the sealed state within the cap section, in a state where the cap section and the nozzle formation surface are brought into sliding contact with each other.

According to this configuration, by relatively moving at least one of the maintenance sheets and the liquid ejection head in a direction that intersects the direction in which the facing surface and the nozzle formation surface approach each other and separate from each other, the sealed state within the cap section formed by the abutment between the cap section and the nozzle formation surface is released. That is, unlike a case where the valve is forced to open, the sealed state with the cap section is released easily.

In the liquid ejecting apparatus according to the second aspect of the invention, preferably, the sheet transport mechanism includes a plurality of transport rollers and a plurality of belts hung between the transport rollers, and each of the belts is disposed so as to abut on a portion where the communication hole of the maintenance sheet transported to the facing position is not formed.

According to this configuration, when the maintenance sheet has been disposed in the facing position, a portion where the communication hole is formed in the maintenance sheet does not abut on each belt. Therefore, when liquid is discharged to the outside of the cap section via the communication hole from the inside of the cap section with the result that the valve has operated to open, this liquid is inhibited from adhering to each belt.

In the liquid ejecting apparatus according to the second aspect of the invention, preferably, the liquid ejection nozzles are formed in the liquid ejection head over the overall width of the liquid ejection region of the target along the direction that intersects the transport direction of the target.

Since a so-called full-line liquid ejection head is generally large-sized, it is difficult to move this liquid ejection head to perform various maintenance operations. In such a liquid ejecting apparatus, various maintenance operations can be easily performed by transporting the maintenance sheet by the sheet transport mechanism.

Other features and advantages of the invention will be obvious from the following detailed description, and the accompanying drawings for explaining the features of the invention.

BRIEF DESCRIPTION OF THE DRAWINGS

The features of the invention to be considered novel will be obvious particularly from the attached claims.

The invention involving advantages and profits will be understood by referring to the description of the present preferable embodiments shown below, together with the accompanying drawings.

The invention will be described with reference to the accompanying drawings, wherein like numbers reference like elements.

FIG. 1 is a schematic view showing the whole configuration of an ink jet printer according to the invention.

FIG. 2 is a schematic plan view of a maintenance sheet according to the invention.

FIG. 3 is a sectional view taken along the line III-III of FIG. 2.

FIG. 4 is a sectional view taken along the line IV-IV of FIG. 2.

FIG. 5 is a schematic sectional view of the maintenance sheet in a state where an upper end of a volume variable section in the maintenance sheet has been displaced downward.

FIG. 6 is a schematic sectional view of the maintenance sheet, showing the height relationship between a wiper section and a first cap section in the maintenance sheet.

FIG. 7 is a sectional view taken along the line VII-VII of FIG. 2.

FIG. 8 is a block diagram showing the electrical configuration of an ink jet printer.

FIG. 9 is a flow chart for explaining a maintenance execution processing routine.

FIG. 10 is a flow chart for explaining a sheet transport processing routine.

FIG. 11 is a flow chart for explaining a flushing processing routine.

Figure 12:
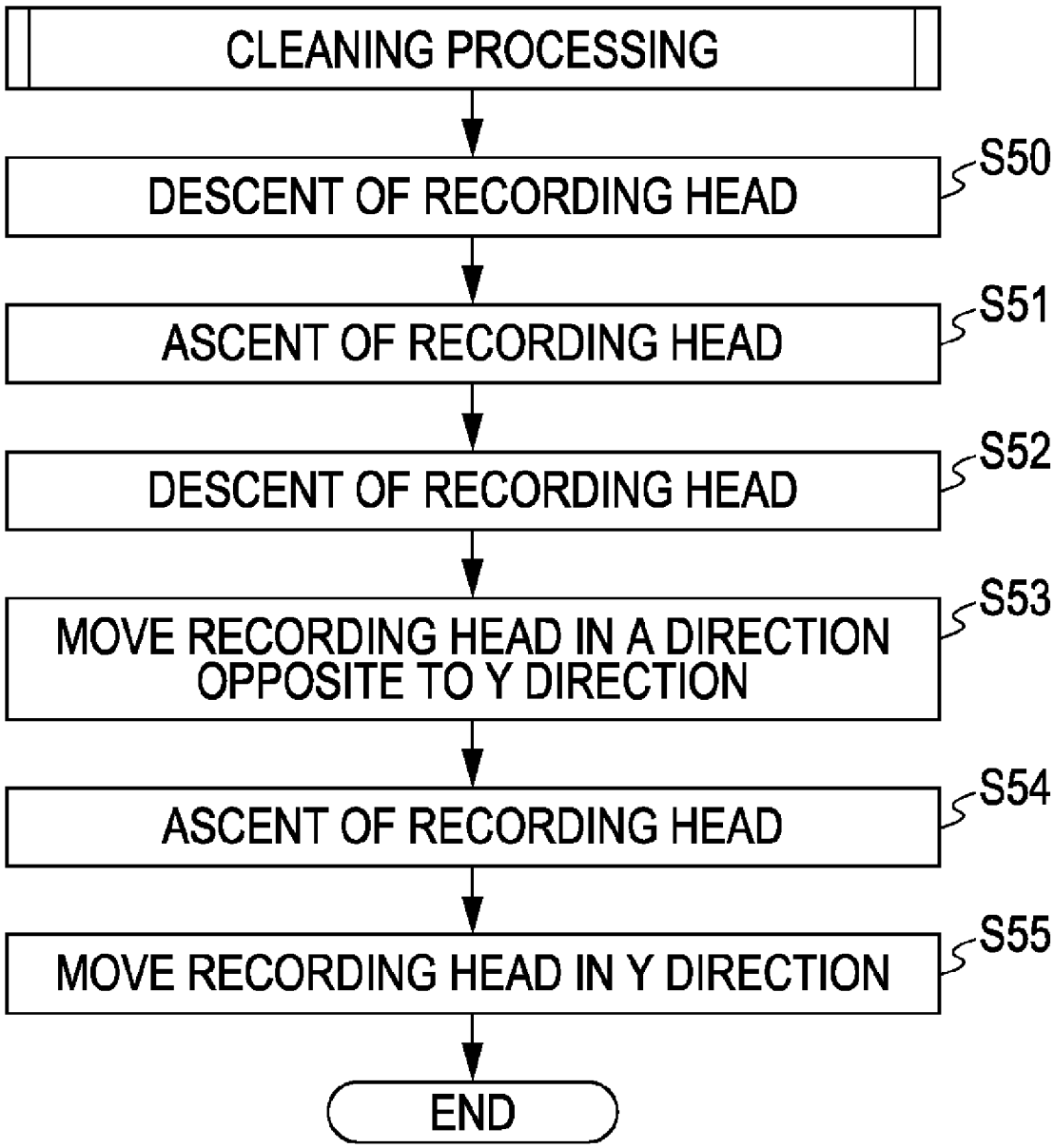

FIG. 12 is a flow chart for explaining a cleaning processing routine.

Figure 13:
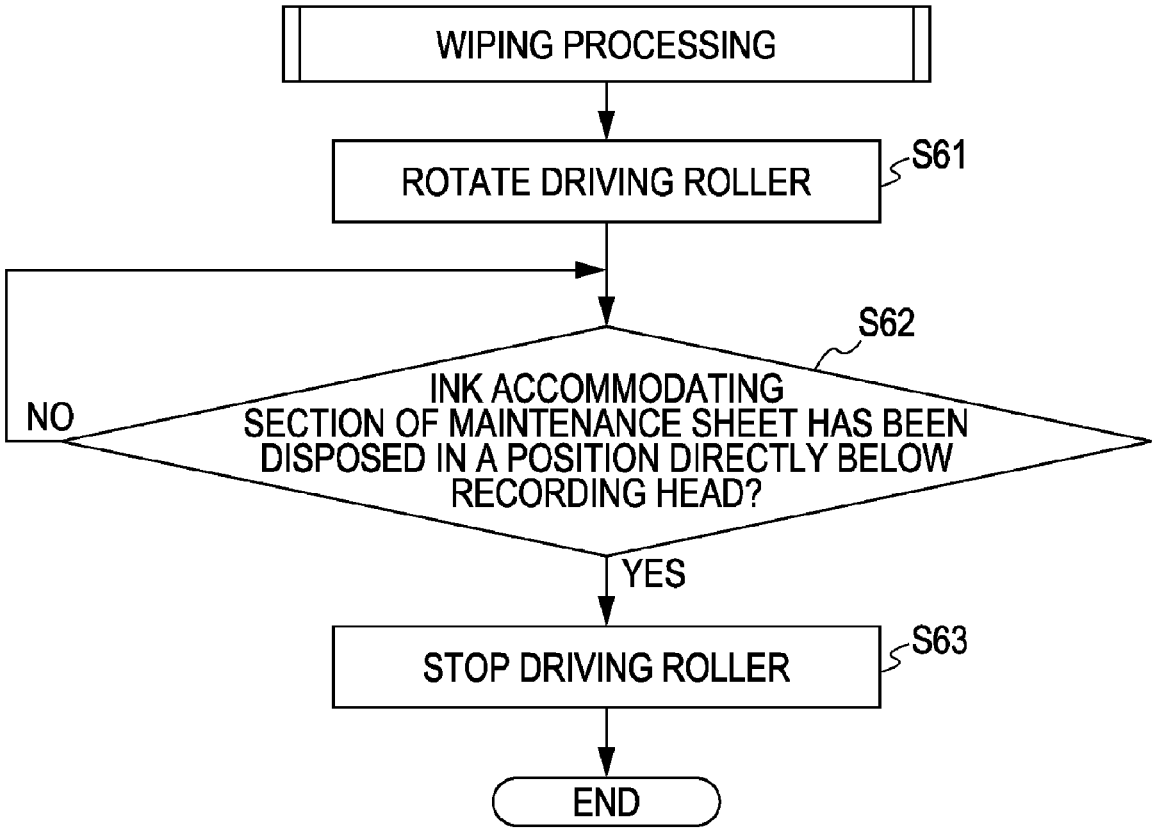

FIG. 13 is a flow chart for explaining a wiping processing routine.

Figure 14:
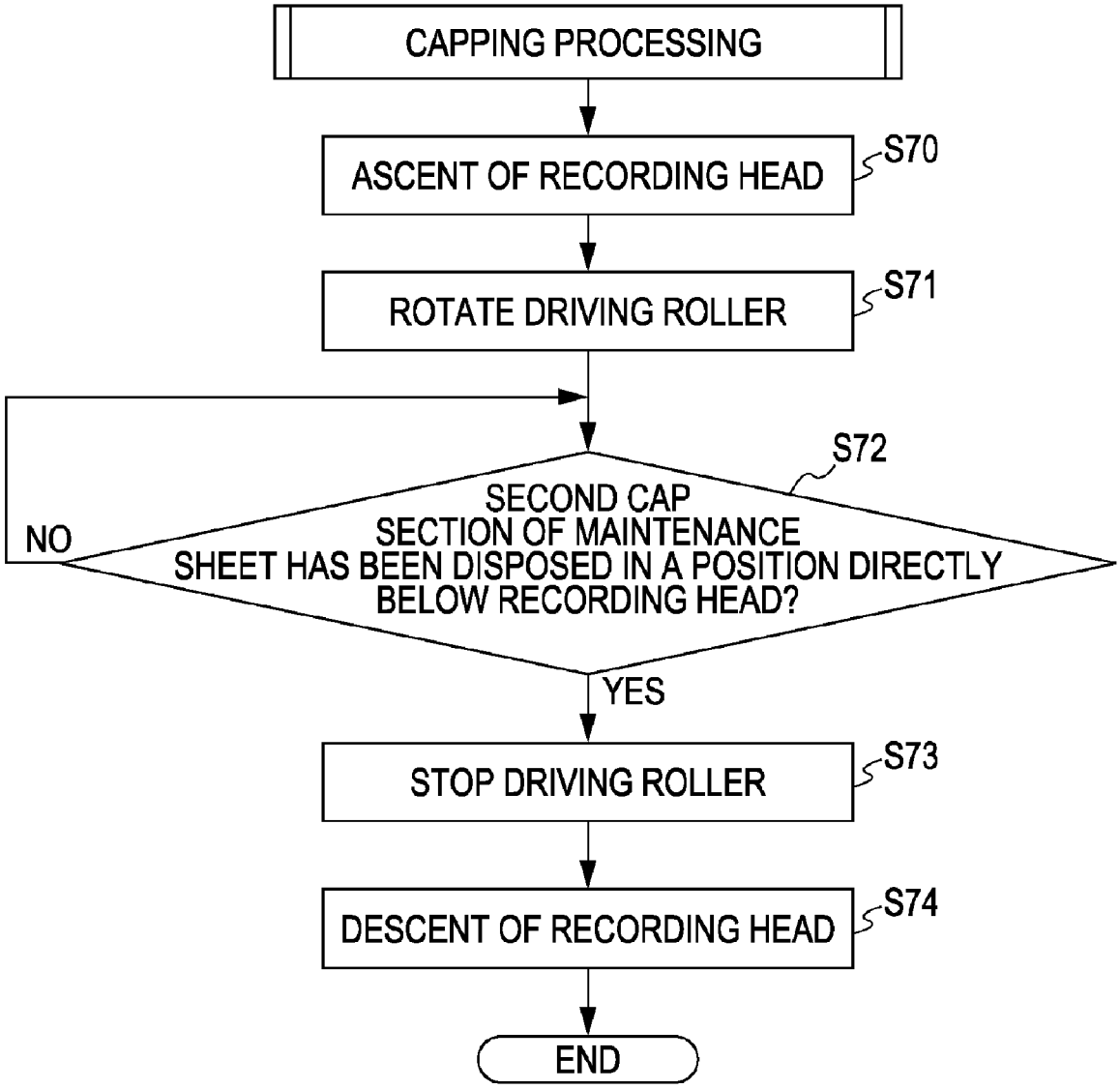

FIG. 14 is a flow chart for explaining a capping processing routine.

Figure 15:
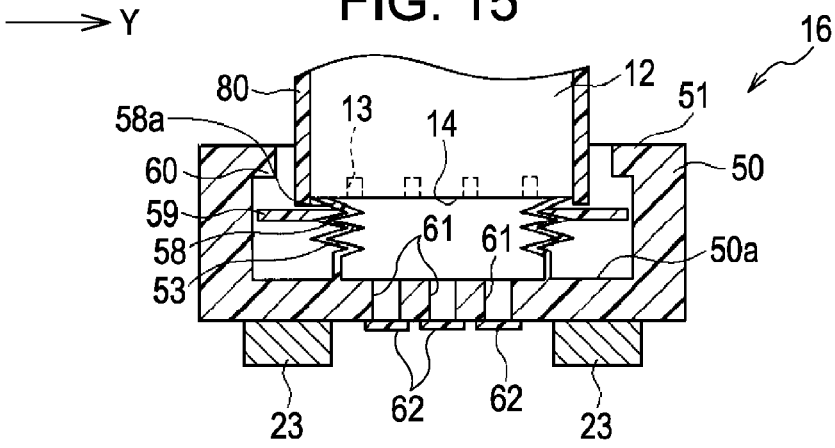

FIG. 15 is a schematic sectional view of a recording head provided with a head cover.

Figure 16:
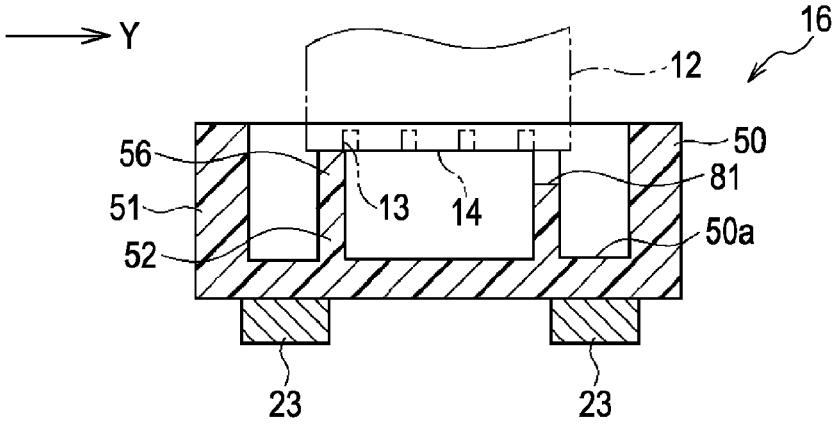

FIG. 16 is a schematic sectional view of a second cap section in another embodiment.

Figure 17:
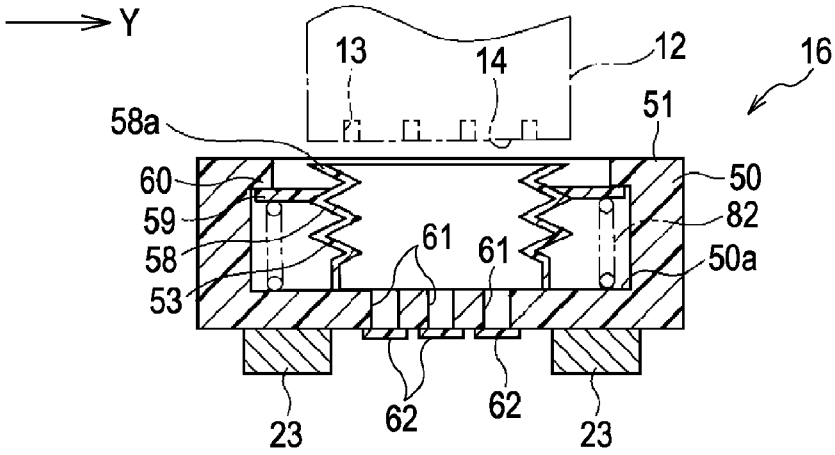

FIG. 17 is a schematic sectional view of a first cap section in another embodiment.

DESCRIPTION OF EXEMPLARY EMBODIMENTS

Hereinafter, one embodiment of the invention will be described with reference to FIGS. 1 to 14.

Figure 1:
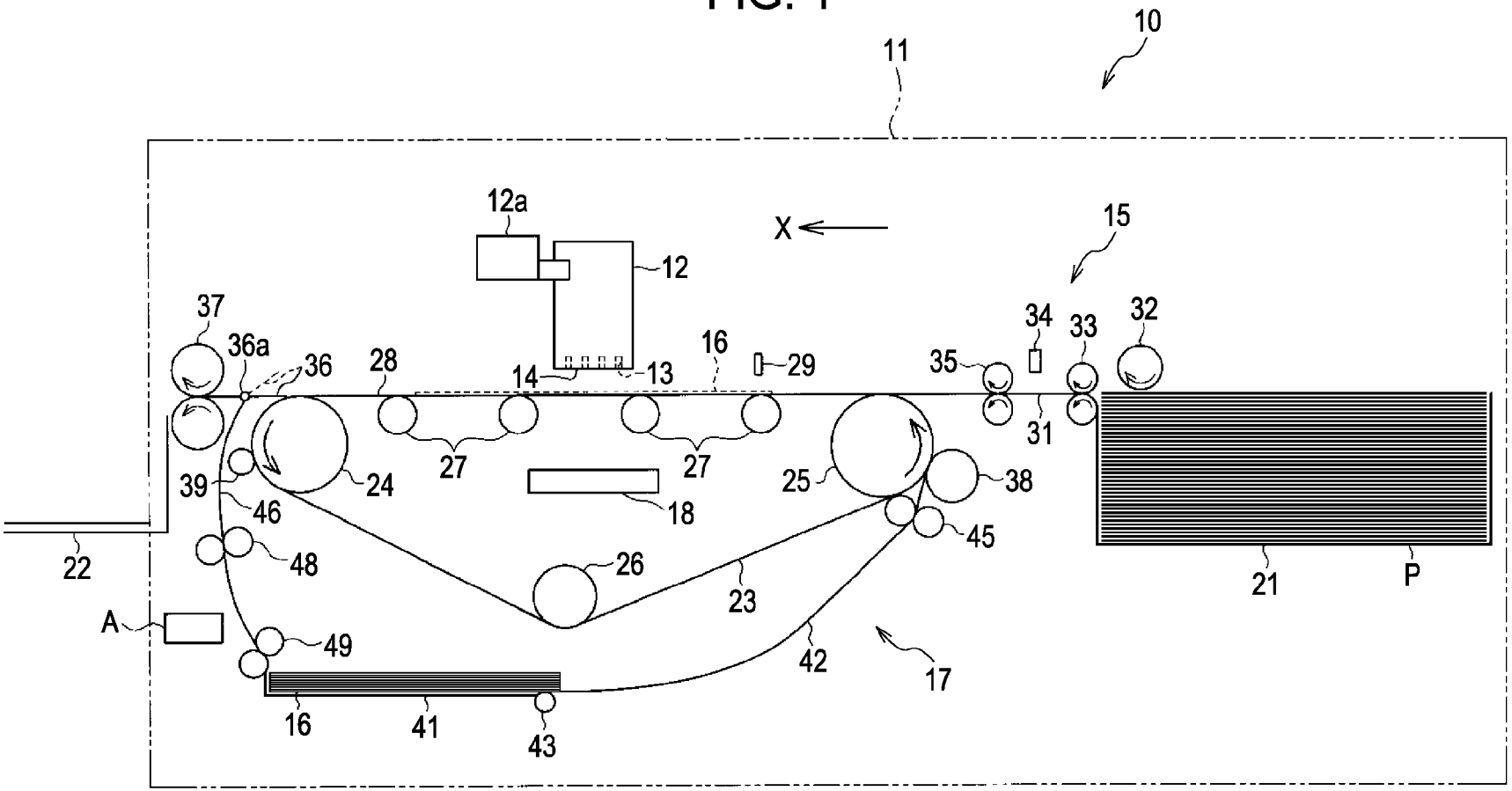

As shown in FIG. 1, an ink jet printer (hereinafter referred to as "printer") 10 serving as a liquid ejecting apparatus in the present embodiment includes a substantially box-shaped body frame 11, and a recording head 12 serving as a liquid ejection head that is arranged substantially in the center of the body frame 11 to discharge (eject) ink as a liquid to sheet P serving as a target.

In a lower surface of this recording head 12, openings of a number of nozzles (liquid ejection nozzles) 13 are formed over the overall width of a liquid ejection region of a sheet P along a horizontal direction (Y direction orthogonal to the sheet plane of FIG. 1 and shown by an arrow in FIG. 2) substantially orthogonal to a transport direction (X direction shown by an arrow in FIG. 1) of the sheet P. In this respect, the printer 10 of the present embodiment is constituted as a so-called full-line-head type printer 10 capable of high-speed printing, as compared with a printer of a type in which the recording head 12 is disposed in a carriage that reciprocates in a direction that intersects the transport direction of the sheet P. In addition, the surface of a region in the lower surface of the recording head 12 where the openings of a number of the nozzles 13 are formed is used as a nozzle formation surface 14.

Further, a plurality of ink cartridges (not shown) that store different kinds of color ink are connected to the recording head 12. During printing, the ink stored in each ink cartridge is supplied to the recording head 12 as needed in a state where the pressure thereof is adjusted to a predetermined pressure. Further, the recording head 12 is adapted to be movable in a direction (vertical direction in FIG. 1) in which it approaches or separates from a main transport path 28 that faces the nozzle formation surface 14 of the recording head 12 with a predetermined gap therefrom when being driven by a recording head moving mechanism 12*a*. In addition, in the present embodiment, when a transported sheet P deviates in position in the direction (Y direction of FIG. 2) substantially orthogonal to the above transport direction, the recording head 12 is adapted to move in the direction substantially orthogonal to the above transport direction to such an extent that it can respond to the positional deviation amount, on the basis of the driving of the recording head moving mechanism 12*a*.

A sheet transport mechanism 15 for transporting a sheet P and a sheet transport mechanism 17 for transporting a maintenance sheet 16 as will be described below are arranged below the recording head 12 in the body frame 11. Further, a recovery section 18 (also referred to as "waste ink tank") for recovering the ink discharged from the recording head 12 at the time of cleaning is arranged in a position directly below the recording head 12, that is, in a lower position than the main transport path 28 as will be described below. Here, the maintenance sheet 16 is a sheet that abuts on the nozzle formation surface 14 of the recording head 12 when the printer 10 is in a printing idling state to suppress drying of the ink within the nozzles 13, to execute cleaning of sucking ink from the recording head 12, to wipe the nozzle formation surface 14, or to execute flushing by the recording head 12, and the details are thereof will be described below.

The sheet transport mechanism 15 includes a sheet feed tray 21 that accommodates a plurality of sheets P in a stacked state, a sheet discharge tray 22 that accommodates a sheet P after printing, and a plurality of (two in FIG. 2) endless transport belts 23 for passing and transporting a fed sheet P directly below (position that faces the nozzle formation surface 14) the nozzle formation surface 14 of the recording head 12. These transport belts 23 are juxtaposed along the direction (the Y direction) orthogonal to the sheet plane in FIG. 1. Further, each transport belt 23 is hung in a tensioned state by a driving roller (transport roller) 24 that is driven after start of printing, a driven roller (transport roller) 25 that rotates so as to follow the driving roller 24 located at the same position as the height of the driving roller 24, and a tension roller 26 that is located below an intermediate position between the driving roller 24 and the driven roller 25. That is, the driving roller 24, the driven roller 25, and the tension roller 26 are arranged such that each transport belt 23 forms a triangular shape when each transport belt 23 is hung by the three rollers 24, 25, and 26.

Moreover, a plurality of (four in the present embodiment) auxiliary transport rollers 27 are disposed between the driving roller 24 and the driven roller 25. In each transport belt 23, the upper surface of a belt portion that is horizontally supported from below by each auxiliary transport roller 27 between the driving roller 24 and the driven roller 25 constitutes the main transport path 28. A printing start detecting sensor 29 is provided in a position that is closer to the sheet feed tray 21 than the recording head 12 above the main transport path 28. The printing start detecting sensor 29 is used to obtain a start point where the feed amount when a sheet P (or maintenance sheet 16) is transported to a printing position (or facing position) directly below the nozzle formation surface 14 of the recording head 12 from an arrangement position of the printing start detecting sensor 29 is counted.

Further, a first guide plate 31 for guiding sheets P from the sheet feed tray 21 to one end side (driven roller 25 side on the right end side in FIG. 1) of the main transport path 28 is provided between the sheet feed tray 21 and each transport belt 23. Also, a pickup roller 32 for taking out a sheet P accommodated in the uppermost portion of the sheet feed tray 21 is provided above the sheet feed tray 21, and a separation roller pair 33 for sending with certainty only one of overlappingly picked-up sheets P by friction is provided in a connecting portion between the sheet feed tray 21 and the first guide plate 31.

Moreover, a sheet end detecting sensor 34 that detects that a sheet P has passed through the separation roller pair 33 and a sheet gate roller pair 35 that is driven when the sheet P is delivered from on the first guide plate 31 to the main transport path 28 is provided in a position above the first guide plate 31. Also, a sheet P accommodated in the sheet feed tray 21 is supplied onto the main transport path 28 as the pickup roller 32, the separation roller pair 33, and the sheet gate roller pair 35 rotate in a direction in which the sheet P is delivered towards the main transport path 28.

Moreover, a selector 36 for guiding a sheet P to the sheet discharge tray 22 from the other end side (driving roller 24 side that is the left end side in FIG. 1) of the main transport path 28 and feeding a maintenance sheet 16 towards the sheet tray 41 as will be described below is provided between each transport belt 23 and the sheet discharge tray 22. The selector 36 is rotatably supported with a base end (left end in FIG. 1) 36*a* downstream in the sheet transport direction as a fulcrum. When the selector is in a horizontal state (closed state) shown by the solid line in FIG. 1, the main transport path 28 and the sheet discharge tray 22 are connected to each other via the selector 36. On the other hand, when the selector 36 is in an upwardly inclined state (open state) as shown by the broken line in FIG. 1, connection between the main transport path 28 and the sheet discharge tray 22 is broken, and the main transport path 28 is connected to a transport path (third guide plate 46) to the sheet tray 41 via the selector 36.

Further, a sheet discharge roller pair 37 for discharging a sheet P upon which printing has finished to the sheet discharge tray 22 is provided between the base end 36*a* of the selector 36, and the sheet discharge tray 22. Accordingly, when the selector 36 is in the horizontal state (closed state), each transport belt 23 and the sheet discharge roller pair 37 rotate whereby a sheet P after printing is discharged to the sheet discharge tray 22 from the main transport path 28.

Moreover, a charging roller 38 is disposed in correspondence with the driven roller 25 so as to rotate with each transport belt 23 interposed between the peripheral surfaces thereof, and a discharging roller 39 is disposed in correspondence with the driving roller 24 so as to rotate with each transport belt 23 interposed between the peripheral surfaces thereof. Accordingly, since the whole surface of each transport belt 23 that serves as a supporting surface of a sheet P (and a maintenance sheet 16) is negatively charged by the charging roller 38, the sheet P and the maintenance sheet 16 are attracted onto and held by the main transport path 28 of each transport belt 23.

The sheet transport mechanism 17 includes a sheet tray 41 that accommodates a plurality of maintenance sheets P (for example, about five to ten) in a stacked state, and each transport belt 23 for passing a maintenance sheet 16 directly below (position that faces the nozzle formation surface 14) the nozzle formation surface 14 of the recording head 12 from the sheet tray 41 to transport it to the sheet tray 41. That is, each transport belt 23 of the above sheet transport mechanism 15 is also used as a transport belt of the sheet transport mechanism 17.

The sheet tray 41 is disposed below each transport belt 23. Further, a smoothly curved second guide plate 42 for guiding a maintenance sheet P between the sheet tray 41 and one end side (driven roller 25 side on the right end side in FIG. 1) of the main transport path 28 is provided on one end side (right end side in FIG. 1) of the sheet tray 41. The second guide plate 42 is composed of a pair of belt-like plate pieces that are disposed parallel to each other with a slightly shorter gap than the width of a maintenance sheet 16 in a direction that intersects a guiding direction of the maintenance sheet 16. Further, a sheet feed roller 43 for taking out a maintenance sheet 16 accommodated in the lowermost portion of the sheet tray 41 towards the second guide plate 42 is provided below one end side (lower right corner in FIG. 1) of the sheet tray 41.

Moreover, a sheet gate roller pair 45 that is driven when a maintenance sheet 16 is delivered from on the second guide plate 42 to the main transport path 28 is provided at the end of the second guide plate 42 (specifically between the pair of belt-like pieces) in the transport direction. Also, a maintenance sheet P accommodated in the sheet feed tray 41 is supplied onto the main transport path 28 as the sheet feed roller 43 and the sheet gate roller pair 16 rotate in a direction (direction shown by an arrow in FIG. 1) in which the maintenance sheet P is delivered towards the main transport path 28.

Meanwhile, a partially curved third guide plate 46 for guiding a maintenance sheet P from the other end side (driving roller 24 side that is the left end side in FIG. 1) of the main transport path 28 to the other end side (left end side in FIG. 1) of the sheet tray 41 is provided on the other end side (right end side in FIG. 1) of the sheet tray 41.

The third guide plate 46 is composed of a pair of belt-like plate pieces that are disposed parallel to each other with a gap slightly shorter than the width of a maintenance sheet 16 in a direction that intersects a guiding direction of the maintenance sheet 16. As described above, when the selector 36 is in the upwardly inclined state (open state shown by the broken line in FIG. 1), the main transport path 28 is connected to the third guide plate 46 via the selector 36. Moreover, a sheet transport roller pair 48 for transporting a maintenance sheet 16 towards the sheet tray 41 is provided in the course of a transport path of the maintenance sheet 16 in the third guide plate 46.

Further, a sheet discharge roller pair 49 for discharging a maintenance sheet 16 again to the sheet tray 41 after start of printing is provided at the end of the third guide plate 46 on the side of the sheet tray 41. Accordingly, when the selector 36 is in the upwardly inclined state (open state), each transport belt 23, the sheet transport roller pair 48, and the sheet discharge roller pair 49 rotate whereby a maintenance sheet 16 is discharged towards the sheet tray 41. In addition, in the present embodiment, the location of accommodated maintenance sheets 16 in the sheet tray 41 corresponds to a non-facing position, and the position that faces the nozzle formation surface 14 of the recording head 12 on the main transport path 28 of each transport belt 23 corresponds to a facing position.

Further, the printer 10 is provided with a blower A that blows hot air against a facing surface 50*a* (surface that faces the recording head 12 in a position directly below the recording head 12) of a sheet body 50 in a maintenance sheet 16 transported along the third guide plate 46.

Next, a maintenance sheet 16 of the present embodiment will be described below with reference to FIGS. 2 to 7.

Figure 2:
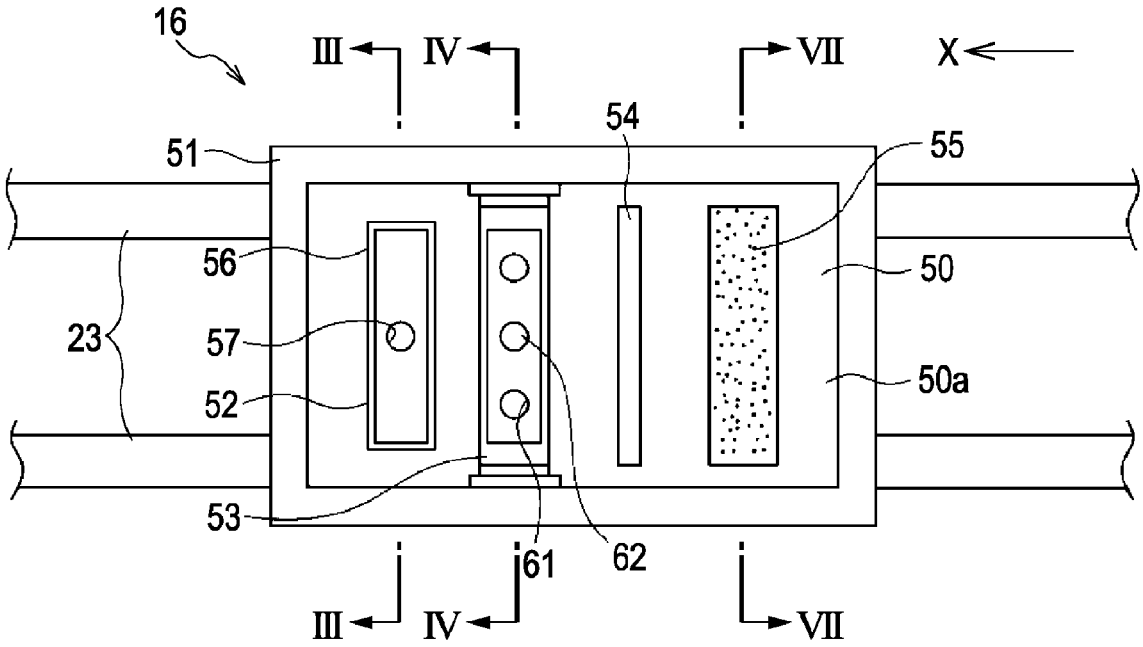

As shown in FIG. 2, the maintenance sheet 16 is a sheet-like member that has a rectangular shape in plan view, and includes a sheet body 50 made of an elastic material (for example, made of synthetic resin). The sheet body 50 has the facing surface 50*a* that faces the nozzle formation surface 14 of the recording head 12 when the maintenance sheet 16 is disposed in the above facing position. Also, an edge projection 51 that has a rectangular annular shape is formed so as to project from an edge on the facing surface 50*a* of the sheet body 50. In addition, the peripheral surface of each roller (sheet transport roller pair 48, etc.) that is located on the side of the facing surface 50*a* of the sheet body 50 in the sheet transport mechanism 17 at the time of transport of the maintenance sheet 16 abut on the edge projection 51 of the sheet body 50.

Further, a second cap section 52, a first cap section 53, a wiper section 54, and an ink accommodating section 55 are formed in the sheet body 50 such that they run from one side (left side in FIG. 2) of the maintenance sheet 16 in the transport direction to the other side (right side in FIG. 2) thereof on the facing surface 50*a* surrounded by the edge projection 51. In addition, the first cap section is a cap section with a suction function the internal volume of which is made variable in order to execute cleaning, and the second cap section 52 is another cap section with no suction function in which drying within each nozzle 13 can be suppressed (that is, the nozzle formation surface 14 can be capped) when the maintenance sheet abuts on the nozzle formation surface 14 of the recording head 12. Further, the wiper section 54 is a section for wiping the nozzle formation surface 14 of the recording head 12, and the ink accommodating section 55 is a liquid accommodating section for accommodating the ink discharged as a waste liquid from the recording head 12 by flushing.

In the present embodiment, as described above, the first cap section 53 and the wiper section 54 are arranged such that they are adjacent to each other in a predetermined direction as the transport direction (the above X direction) of the maintenance sheet 16. Further, the ink accommodating section 55 is adjacent to the wiper section 54 in the above predetermined direction, and is disposed on the side opposite the first cap section 53 in the above predetermined direction, as seen from the wiper section 54.

Figure 3:
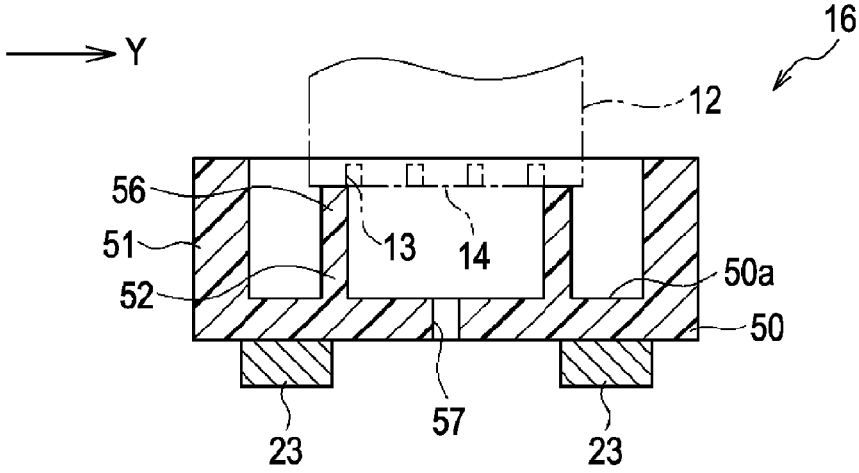

The second cap section 52, as shown in FIGS. 2 and 3, includes a releasing projection 56 that has a rectangular annular shape, and the releasing projection 56 is disposed on the side of the facing surface 50*a* of the sheet body 50. The releasing projection 56 is formed such that the shape of a contour inside the projection becomes larger than a portion where each nozzle 13 is formed in the nozzle formation surface 14 of the recording head 12. When the recording head 12 moves towards the second cap section 52 disposed in a position directly below the recording head 12, an upper end of the second cap section 52 in FIG. 3 abuts on the nozzle formation surface 14 (that is, surface outside a portion where each nozzle 13 is formed) of the recording head 12. That is, the second cap section 52 forms a sealed space between itself and the nozzle formation surface 14 of the recording head 12 so as to cap the nozzle formation surface 14. In addition, the releasing projection 56 is formed such that the projection height (height thereof in the vertical direction in FIG. 3) thereof from the facing surface 50*a* becomes smaller than the projection height of the edge projection 51 from the facing surface 50*a*.

Further, an atmosphere release hole 57 for allowing a space surrounded by the releasing projection 56 to always communicate with a space on the side of the non-facing surface (on the side of the lower surface in FIG. 3) of the sheet body 50 is formed in the portion of the sheet body 50 corresponding to the second cap section 52. The atmosphere release hole 57 is a substantially central portion in the center in the horizontal direction of FIG. 3, and is formed in a position where it is sandwiched between the respective transport belts 23 in the horizontal direction in FIG. 3.

Figure 4:
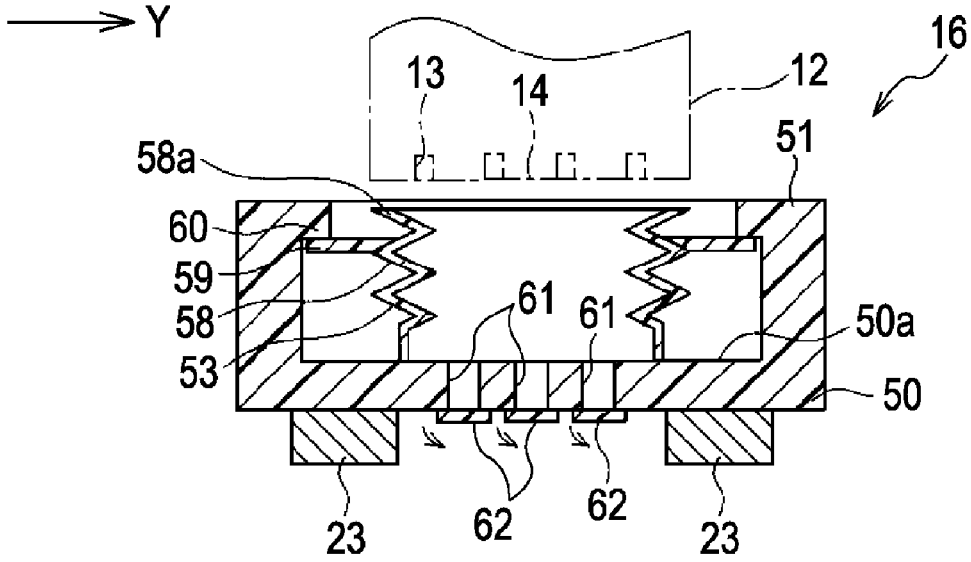

The first cap section 53, as shown in FIGS. 2 and 4, has a substantially rectangular cylindrical shape, and includes a volume variable section 58 the internal volume of which is made variable. The volume variable section 58 is arranged on the side of the facing surface 50*a* of the sheet body 50. Further, since the volume variable section 58 is made of an elastic material, when the upper end (upper end in FIG. 4, i.e., an opening end 58*a* having an opening on the side of the nozzle formation surface 14) thereof is not pressed downward by the recording head 12, the projection height of the opening end from the facing surface 50*a* is biased in a direction in which it becomes higher than the projection height of the edge projection 51 from the facing surface 50*a*. Accordingly, in the present embodiment, a biasing member that biases the upper end 58*a* of the volume variable section 58 towards the nozzle formation surface 14 of the recording head 12 is constituted by a side wall of the volume variable section 58.

Moreover, the volume variable section 58 is formed such that the shape of the opening of the upper end 58*a* thereof becomes larger than a portion where each nozzle 13 is formed in the nozzle formation surface 14 of the recording head 12. Also, when the recording head 12 moves towards the volume variable section 58 (first cap section 53) disposed in a position directly below the recording head 12 by driving of the recording head moving mechanism 12*a*, the upper end 58*a* of the volume variable section 58 elastically abuts on the nozzle formation surface 14 (that is, surface outside a portion where each nozzle 13 is formed) of the recording head 12. That is, the volume variable section 58 forms a sealed space between itself and the nozzle formation surfaces 14 of the recording head 12. Accordingly, in the present embodiment, the recording head moving mechanism 12*a* functions as a relative movement mechanism that moves one of the recording head 12 and the maintenance sheet 16 relative to each other in a direction in which the nozzle formation surface 14 and the facing surface 50*a* approach each other and separates the one from the other.

Figure 5:
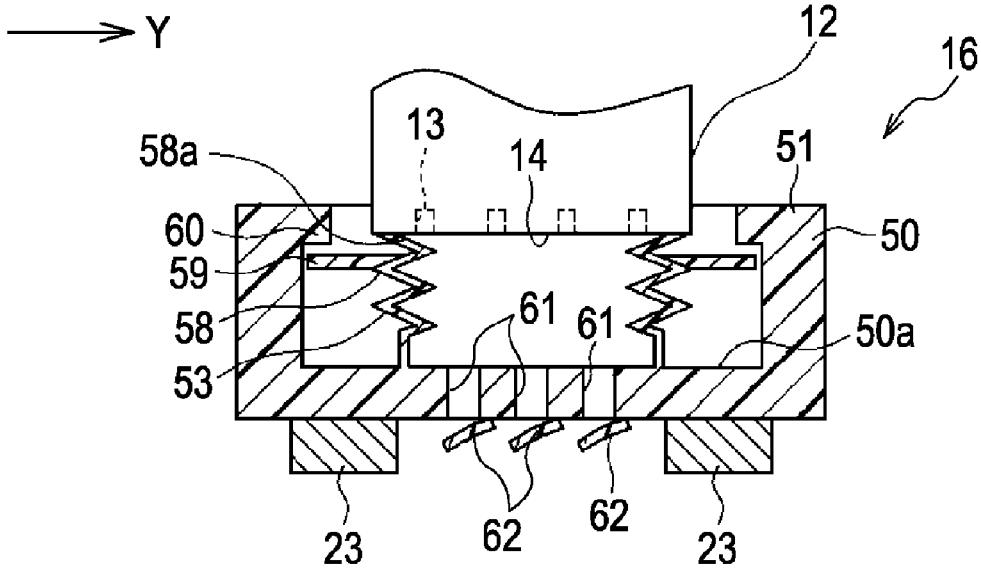

When the upper end 58*a* of the volume variable section 58, as shown in FIG. 5, has been displaced downward from above by the recording head 12, the volume variable section 58 is elastically deformed whereby the internal volume thereof becomes small. On the other hand, when the recording head 12 is moved upward from a state where the internal volume of the volume variable section 58 has become small, the upper end 58*a* of the volume variable section 58 is displaced upward in accordance with the elastic restoring force of the volume variable section 58 in a state where it has abutted on the nozzle formation surface 14. As the upper end 58*a* of the volume variable section 58 is displaced upward so as to follow the nozzle formation surface 14 of the recording head 12 in this way, the internal volume of the volume variable section 58 becomes large.

In the outer wall of the volume variable section 58, a side portion on one side (left side in FIG. 4) of both side portions along the above Y direction is formed with a locking piece 59 that projects to one side, and a side portion on the other side (right side in FIG. 4) is formed with a locking piece 59 that projects to the other side. Further, locking portions 60 that project inward are formed in upper ends of the cap sections corresponding to the volume variable section 58 (the first cap section 53) in the Y direction in both the side portions (left and right side portions in FIG. 4) along the X direction in the edge projection 51 of the sheet body 50.

As for the corresponding locking piece 59 of the volume variable section 58, when the internal volume of the volume variable section 58 becomes gradually large from a state (state shown in FIG. 5) where the internal volume thereof is small, the corresponding locking piece 59 abuts on the lower surface of a corresponding locking portion 60. As a result, the internal volume of the volume variable section 58 is restrained from becoming large.

That is, when the recording head 12 has ascended in a state where the upper end 58*a* of the volume variable section 58 has been displaced downward by the recording head 12, the upper end 58*a* of the volume variable section 58 is displaced upward so as to follow the nozzle formation surface 14 of the recording head 12. However, when the height position (the position of the recording head 12 in the separating direction) of the upper end 58*a* of the volume variable section 58 has reached a predetermined position, the corresponding locking piece 59 of the volume variable section 58 is locked by the corresponding locking portion 60, and consequently, the upper end 58*a* of the volume variable section 58 is restrained from being further displaced upward.

In addition, in the present embodiment, when the corresponding locking piece 59 of the volume variable section 58 is locked by the corresponding locking portion 60, the upper end 58*a* of the volume variable section 58 will be located in an uppermost position, and the internal volume within the volume variable section 58 will become a maximum. Even in this state, the relative positional relationship between the corresponding locking piece 59 in the volume variable section 58 and the corresponding locking portion 60 in the edge projection 51 of the sheet body 50 is set such that the upper end 58*a* of the volume variable section 58 is located in a position lower than the upper end of the edge projection 51.

Further, a plurality of (three in the present embodiment) discharge holes 61 as communication holes for allowing the space within the volume variable section 58 to communicate with the space on the side of the non-facing surface (lower surface in FIG. 4) of the sheet body 50 is formed in the portion of the sheet body 50 corresponding to the first cap section 53. These discharge holes 61 are formed along the direction (horizontal direction, i.e., Y direction in FIG. 4) substantially orthogonal to the X direction, and are formed in a position where they are sandwiched by the respective transport belts 23 from the horizontal direction in FIG. 4, i.e., a position between the transport belts 23.

Moreover, a plurality of (three in the present embodiment) normally closed valves 62 for independently closing the discharge holes 61 are provided on the side of the non-facing surface of the sheet body 50. Each of the normally closed valves 62 is in a normally closed state, and makes the inside of the volume variable section 58 and the space on the side of the non-facing surface of the sheet body 50 enter a non-communication state. Meanwhile, when the upper end 58*a* of the volume variable section 58, as shown in FIG. 5, has been displaced downward by the recording head 12, the internal volume thereof becomes small, and the internal pressure thereof becomes larger than the external pressure (outside the volume variable section 58). In this case, each of the normally closed valves 62 activates to open, as shown by an arrow in FIG. 4, and each of the discharge holes 61 is opened as shown in FIG. 5. As a result, the inside of the volume variable section 58 and the space on the side of the non-facing surface of the sheet body 50 communicates with each other via each discharge hole 61.

In addition, at this time, if ink accommodated within the first cap section 53, the ink is discharged to the outside of the first cap section 53 from each discharge hole 61. On the other hand, if ink is not accommodated within the first cap section 53, the air equivalent to a change in the internal volume of the volume variable section 58 is discharged from each discharge hole 61. When the internal volume of the volume variable section 58 has been changed by such discharge of ink or air via the discharge holes 61, discharge of ink out of the first cap section 53 is allowed, and collapsing of a meniscus in each nozzle 13 of the recording head 12 by a pressure change can be suppressed. In this case, the biasing force that biases each normally closed valve 62 in a valve closing direction is set to such a biasing force that the normally closed valve 62 is opened by a pressure change smaller than a pressure change that collapses a meniscus in each nozzle 13.

In addition, the recording head 12 of the present embodiment, as described above, is made movable not only in the vertical direction but also in the above Y direction on the basis of driving of the recording head moving mechanism 12*a*. When the recording head 12 has been moved in a direction opposite to the Y direction (left direction in FIG. 5) in a state where the upper end 58*a* of the volume variable section 58 has abutted on the nozzle formation surface 14 of the recording head 12 and thereby the internal volume of the volume variable section has been reduced, a part of the upper end 58*a* of the volume variable section 58 is released from the nozzle formation surface 14. As a part of the upper end 58*a* of the volume variable section 58 is released from the nozzle formation surface 14 in this way, the inside of the volume variable section 58 communicates with the outside (outside of the volume variable section 58) via the upper end 58*a* of the volume variable section 58. That is, as the recording head 12 is moved in a direction opposite to the Y direction by driving of the recording head moving mechanism 12*a* in a state where a sealed space is formed in the volume variable section 58 by abutment between the nozzle formation surface 14 of the recording head 12 and the volume variable section 58 of the first cap section 53, a sealed state within the volume variable section 58 is released. Accordingly, in the present embodiment, the recording head moving mechanism 12*a* also functions as a sealed state releasing mechanism.

Figure 6:
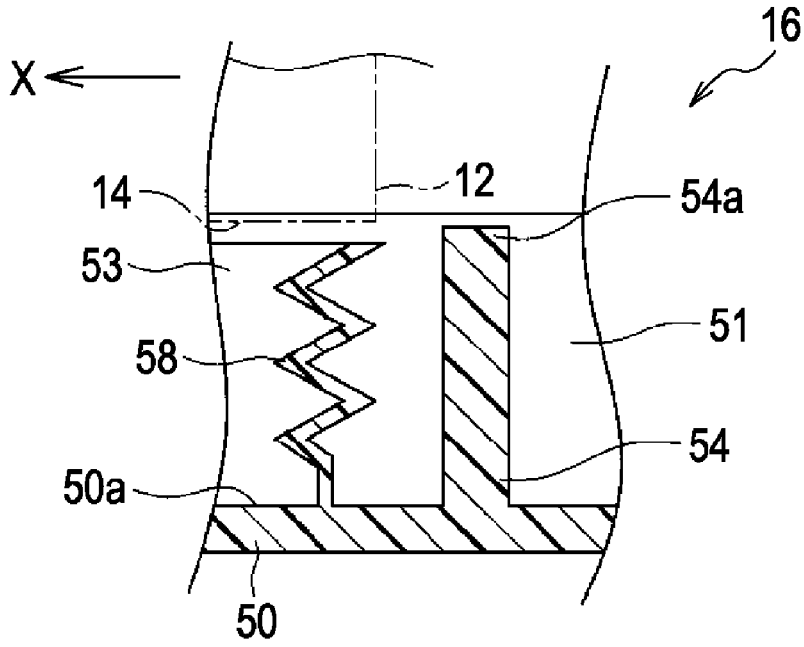
Figure 7:
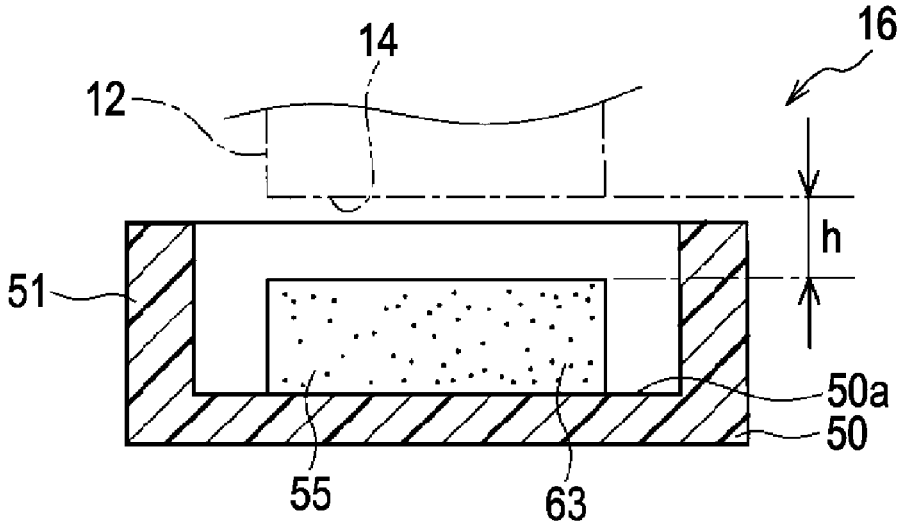

The wiper section 54 is composed of a plate that has a rectangular plate shape and is made of synthetic resin. The wiper section 54 is formed such that the projection height (about 1.5 mm) thereof from the facing surface 50*a* is smaller than the projection height of the edge projection 51 from the facing surface 50*a*. Further, the wiper section 54, as shown in FIG. 6, is formed such that the projection height thereof from the facing surface 50*a* becomes smaller than the projection height of the first cap section 53 from the facing surface 50*a* in a case where the internal volume of the volume variable section 58 becomes the maximum. More specifically, the wiper section 54 is formed such that, when the recording head 12 has been moved upward in a state where the nozzle formation surface 14 has abutted on the volume variable section 58, the tip (upper end in FIG. 6) 54*a* of the wiper section is located in a position higher than the nozzle formation surface 14 immediately after the upper end 58*a* of the volume variable section 58 has been separated from the nozzle formation surface 14 of the recording head 12. In addition, for the sake of convenience of explanation and understanding, description of the transport belts 23 is omitted in FIG. 6. Further, the wiper section 54 of the present embodiment is formed such that the margin of abutment on the nozzle formation surface 14 at the time of wiping of the nozzle formation surface 14 becomes "about 1 mm."

The ink accommodating section 55 includes an ink absorbing member 63 that is made a porous material and has a substantially rectangular parallelepiped shape. The ink absorbing member 63 is fixed to the facing surface 50*a* of the sheet body 50 in the maintenance sheet 16. Also, the ink absorbing member 63 is formed such that the projection height thereof from the facing surface 50*a* becomes smaller than the projection height of the edge projection 51 from the facing surface 50*a*.

Further, the ink accommodating section 55 (ink absorbing member 63), as described above, is a section used at the time of flushing in the maintenance sheet 16. Also, the gap h between the upper end of the ink absorbing member 63, and the nozzle formation surface 14 is set (about 2 mm) that the ink discharged from the recording head 12 is inhibited from being turned into mist when the ink absorbing member 63 accommodates the ink discharged as a waste liquid from the recording head 12 in the above facing position.

Next, the electric configuration of the above printer 10 will be described below with reference to FIG. 8.

Figure 8:
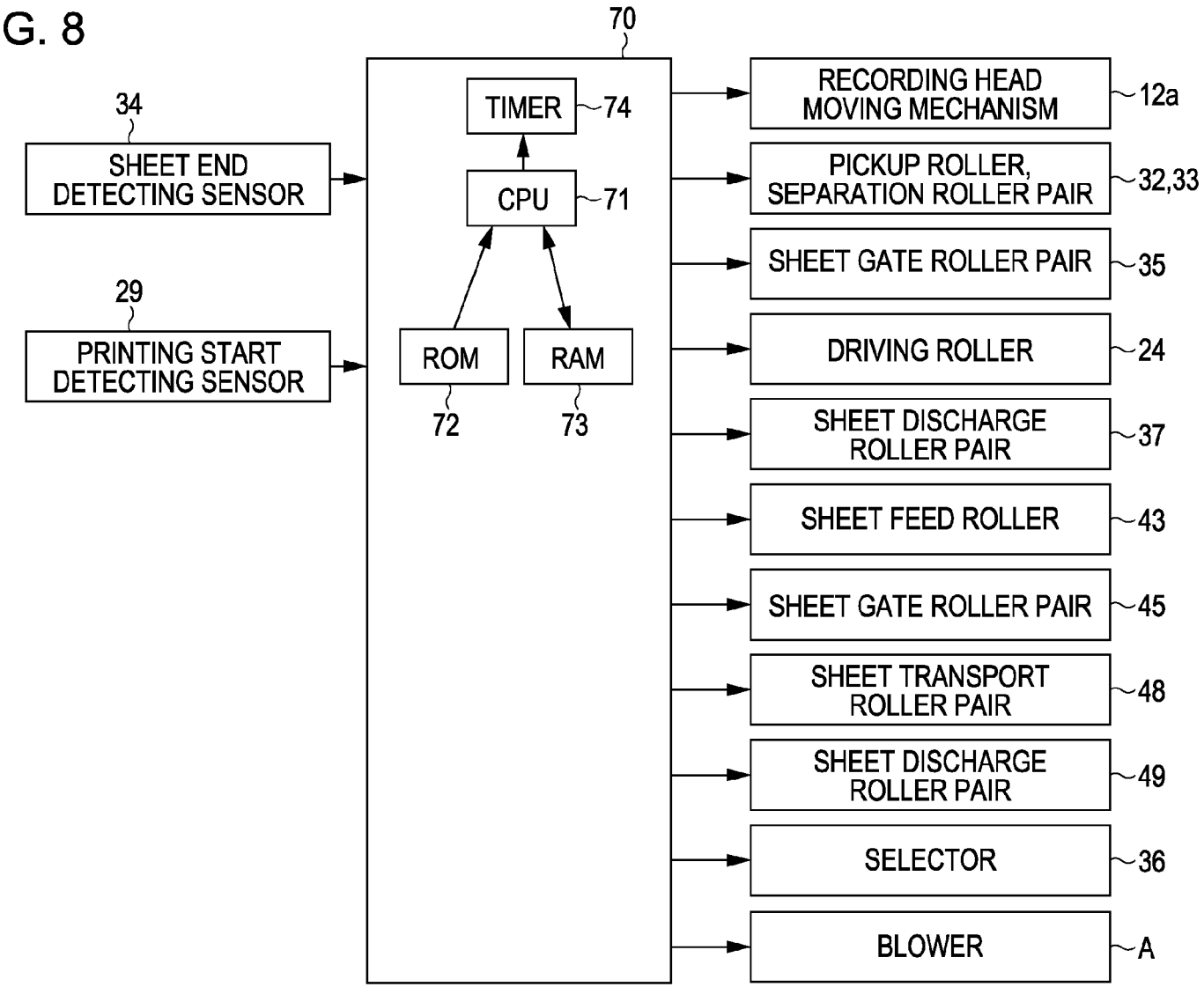
Figure 9:
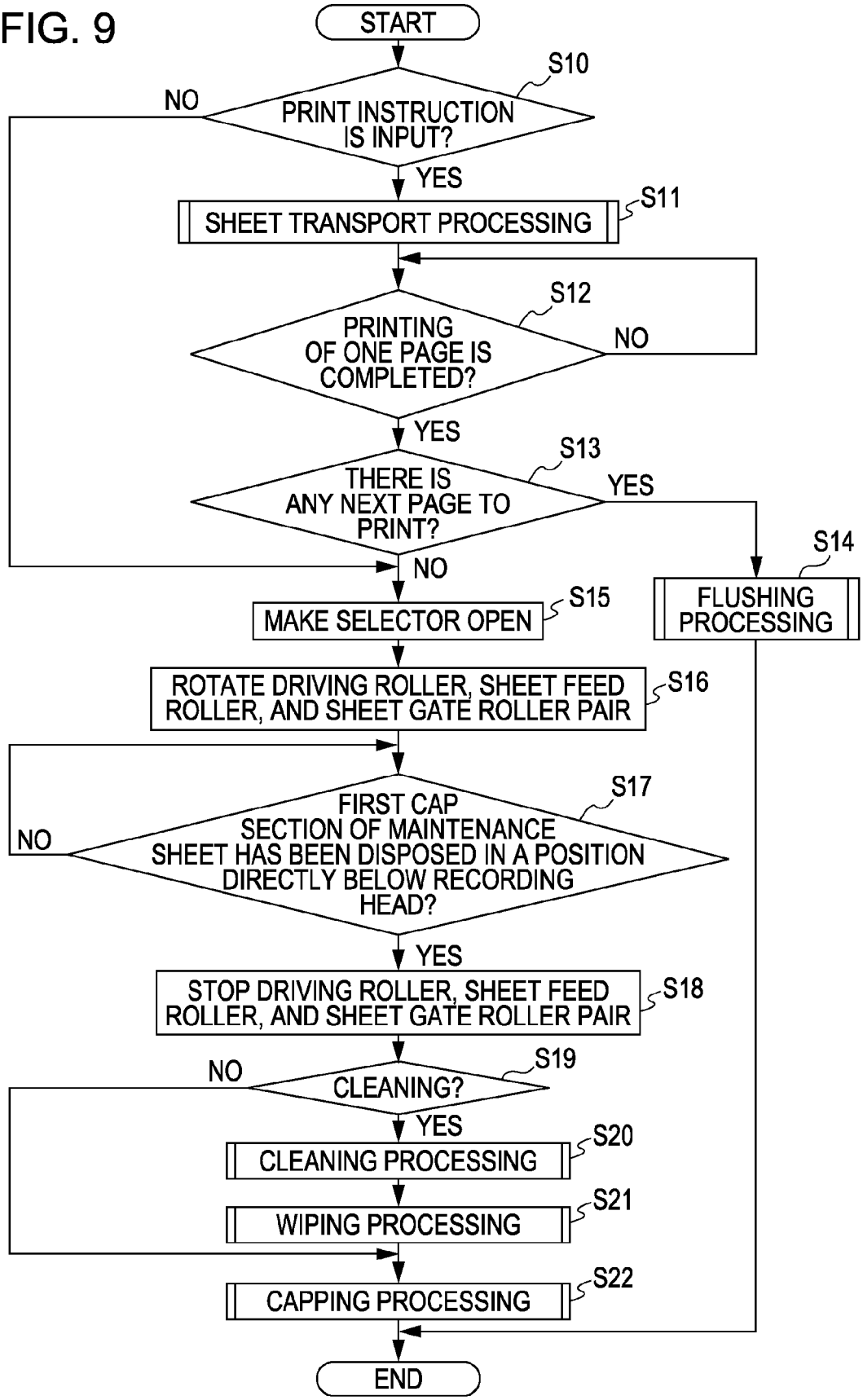

As shown in FIG. 8, the printer 10 includes a control unit 70. The control unit 70 is mainly composed of a digital computer provided with an input interface (not shown), an output interface (not shown), a CPU 71, a ROM 72, a RAM 73, a timer 74, etc., and a driving circuit (not shown) for driving each device.

The sheet end detecting sensor 34 and the printing start detecting sensor 29 are electrically connected to the input interface. Further, the recording head moving mechanism 12*a*, the pickup roller 32, the separation roller pair 33, the sheet gate roller pair 35, the driving roller 24, and the sheet discharge roller pair 37, the sheet feed roller 43, and the sheet gate roller pair 45, the sheet transport roller pair 48, and the sheet discharge roller pair 49, the selector 36, and the blower A are connected electrically to the output interface. Also, the control unit 70 independently controls respective mechanisms (driving roller 24, etc.) on the basis of detection signals from the various sensors 34 and 29.

Further, in the digital computer, control programs for controlling the respective mechanisms (driving roller 24, etc.) etc. are stored in the ROM 72. Various kinds of information, including the size of input signals from the various sensors 34 and 29, which are appropriately rewritten during driving of the printer 10, are stored in the RAM 73. Further, the timer 74 is adapted to measure time (elapsed time, etc.).

In the printer 10 described above, a sheet transport path where the sheet feed tray 21 and the sheet discharge tray 22 are connected to each other via the first guide plate 31 and the main transport path 28 at the time of printing is formed by switching of the selector 36. Further, at the time of transport of a maintenance sheet 16, a sheet transport path where one end of the sheet tray 41 and the other end thereof are connected to each other via the second guide plate 42, the main transport path 28, and the third guide plate 46 is formed.

Accordingly, when the selector 36 is in the horizontal state (closed state) shown by the solid line in FIG. 1, a sheet P taken out of the sheet feed tray 21 is transported via the first guide plate 31 to the main transport path 28. At this time, since each transport belt 23 is charged, the sheet P is attracted onto and held by each transport belt 23. Then, when the sheet P has been transported to the position that faces the nozzle formation surface 14 of the recording head 12, printing (discharge of ink) is executed. The sheet P that has finished the printing is transported on the main transport path 28 as it is, and is discharged to the sheet discharge tray 22 via the selector 36.

Meanwhile, a maintenance sheet 16 taken out of the sheet tray 41 is transported via the second guide plate 42 to the main transport path 28. At this time, since each transport belt 23 is charged similarly to above, the maintenance sheet 16 is attracted onto and held by each transport belt 23. Then, as shown by the broken line FIG. 1, when the maintenance sheet P has been transported to the position that faces the nozzle formation surface 14 of the recording head 12, maintenance operation is executed.

Specifically, when the first cap section 53 of the maintenance sheet 16 has been disposed in a position directly below the recording head 12, cleaning is executed. Further, when the second cap section 52 of the maintenance sheet 16 has been disposed in a position directly below the recording head 12, capping of the nozzle formation surface 14 of the recording head 12 is executed. Further, wiping of the nozzle formation surface 14 is executed by transporting the maintenance sheet 16 in the above X direction in a state where the tip 54*a* of the wiper section 54 has been brought into sliding contact with the nozzle formation surface 14 of the recording head 12. Then, when the ink accommodating section 55 of the maintenance sheet 16 has been disposed in a position directly below the recording head 12, ink is discharged as a waste liquid from each nozzle 13 of the recording head 12. That is, flushing is executed.

Further, when printing is started again, and the selector 36 is in the inclined state (open state) shown by the broken line in FIG. 1, the maintenance sheet 16 is transported on the main transport path 28, and is transported to the third guide plate 46 via the selector 36. At this time, as the blower A is driven, hot air is blown against the facing surface 50*a* of the sheet body 50 in the maintenance sheet 16 that is being moved on the third guide plate 46. Thereafter, the maintenance sheet 16 is again recovered to the sheet tray 41.

Next, a maintenance execution processing routine among control processing routines executed by the control unit 70 of the present embodiment will be described below on the basis of flow charts based on FIGS. 9 to 14.

Now, the control unit 70 executes a maintenance execution processing routine at every predetermined cycle (for example, every 0.01 second). Then, in the maintenance execution processing routine, the control unit 70 determines whether or not a printing instruction is input (Step S10). For example, the control unit determines whether or not a printing execution flag is set. If this determination result is negative, the control unit 70 proceeds to Step S15 the processing of which will be described below. On the other hand, if the determination result of Step S10 is positive, the control unit 70 executes sheet transport processing (it will be described in detail in FIG. 10) as prerequisite processing for performing printing on a sheet P (Step S11).

If this sheet transport processing is completed, printing processing (not shown) on the sheet P was executed. Subsequently, the control unit 70 determines whether or not printing of "one" page has been completed (Step S12). That is, the control unit 70 determines whether or not the printing on one sheet P has been completed. If this determination result is negative, the control unit 70 determines that the printing on one sheet P is being executed, and repeatedly executes the determination processing of Step S12 until the determination processing of Step S12 becomes positive. On the other hand, if the determination result of Step S12 is positive, the control unit 70 determines that the printing on one sheet P has been completed, and determines whether or not there is any next page to print (Step S13).

If this determination result is positive, the control unit 70 executes flushing processing (it will be described in detail in FIG. 11.) to cause flushing to be executed by the recording head 12 before printing on the next page is executed (Step S14). Thereafter, the control unit 70 completes the maintenance execution processing routine for the moment. On the other hand, if the determination result of Step S13 is negative, the control unit 70 determines that printing on all pages has been completed, and then proceeds to Step S15 the processing of which will be described below (Step S15).

In Step S15, the control unit 70 determines that printing based on the printing instruction has been completed, or that any printing instruction is not input, and then makes the selector 36 open. Subsequently, the control unit 70 causes the driving roller 24, the sheet feed roller 43, and the sheet gate roller pair 45 to rotate (Step S16).

Then, the control unit 70 determines whether or not the first cap section 53 (volume variable section 58) of the maintenance sheet 16 has been disposed in a position directly below the recording head 12 (Step S17). Specifically, the control unit 70 reads from the timer 74 the elapsed time after a maintenance sheet 16 transported from the sheet tray 41 is detected by the printing start detecting sensor 29 on the basis of the rotation of the driving roller 24, the sheet feed roller 43, and the sheet gate roller pair 45, and determines whether or not the read elapsed time (hereinafter referred to as "first elapsed time") has reached a first predetermined time or more. This first predetermined time is the time that is taken for the first cap section 53 to move to a position directly below the recording head 12 after passage of a maintenance sheet 16 is detected on the basis of a signal from the printing start detecting sensor 29, and that is set in advance by experiment, simulation, etc. In addition, control is not made by the elapsed time from the point of time of detection of the printing start detecting sensor 29, but control may be made by determining whether or not the number of revolutions of a roller (for example, driving roller 24) from the point of time of detection of the printing start detecting sensor 29 has reached a predetermined number of revolutions.

If the determination result of Step S17 is negative (first elapsed time<first predetermined time), the control unit 70 determines that the first cap section 53 has not yet been moved to a position directly below the recording head 12, and then repeatedly executes the determination processing of Step S17 until the determination result of Step S17 becomes positive. On the other hand, if the determination result of Step S17 is positive (first elapsed time≧first predetermined time), the control unit 70 determines that the first cap section 53 has been moved to a position directly below the recording head 12, and then causes the rotation of the driving roller 24, the sheet feed roller 43, and the sheet gate roller pair 45 to stop (Step S18).

Subsequently, the control unit 70 determines whether or not cleaning is to be executed (Step S19). In addition, as the kind of cleaning executed in the printer 10 in the present embodiment, there are so-called timer cleaning that is executed at every predetermined cycle (for example, for seven days), so-called manual cleaning that is executed using operation of an operation switch (not shown) as a trigger, etc. Therefore, in Step S19, it is determined whether or not the timing to execute timer cleaning has been arrived at, or it is determined whether or not the above operation switch has been operated.

Then, if the determination result of Step 19 is negative, the control unit 70 proceeds to Step S22 the processing of which will be described below, without executing cleaning. On the other hand, if the determination result of Step 19 is positive, the control unit 70 executes cleaning processing (it will be described in detail in FIG. 12) for executing cleaning (Step S20). Subsequently, if the cleaning processing in Step S20 is completed, the control unit 70 executes wiping processing (it will be described in detail in FIG. 13.) for wiping the nozzle formation surface 14 of the recording head 12 (Step S21). Then, if the wiping processing in Step S21 is completed, the control unit 70 proceeds to Step S22 the processing of which will be described below.

In Step S22, the control unit 70 executes capping processing (it will be described in detail to FIG. 14.) for capping the nozzle formation surface 14 of the recording head 12. Thereafter, the control unit 70 completes the maintenance execution processing routine.

Figure 10:
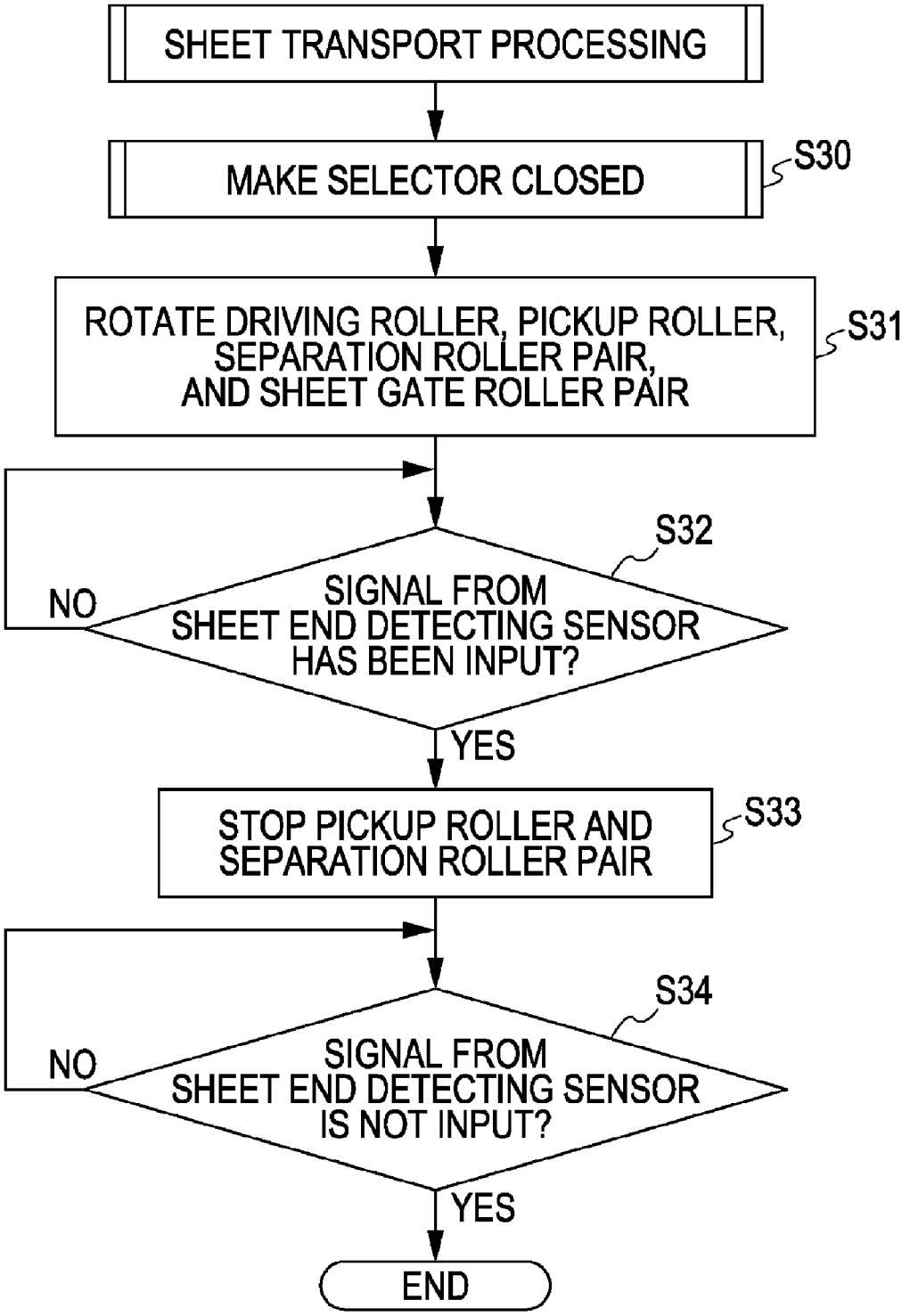

Next, the sheet transport processing (sheet transport processing routine) to be executed in Step S11 described above will be described below with reference to FIG. 10.

Now, in the sheet transport processing routine, the control unit 70 makes the selector 36 closed (Step S30). Subsequently, the control unit 70 causes the driving roller 24, the pickup roller 32, the separation roller pair 33, and the sheet gate roller pair 35 to rotate (Step S31). Then, the control unit 70 determines whether or not a signal from the sheet end detecting sensor 34 has been input (Step S32). That is, the control unit 70 determines whether or not a sheet P starts to be fed onto the main transport path 28 from the sheet feed tray 21.

If the determination result of Step S32 is negative, the control unit 70 determines that the sheet P has not yet been fed onto n the main transport path 28 from the sheet feed tray 21, and then repeatedly executes the determination processing of Step S32 until the determination result of Step S32 becomes positive. On the other hand, if the determination result of Step S32 is positive, the control unit 70 determines that the sheet P has started to be fed onto main transport path 28, and causes the rotation of the pickup roller 32 and the separation roller pair 33 to stop (Step S33).

Next, the control unit 70 determines whether or not a signal from the sheet end detecting sensor 34 is no longer input (Step S34). If this determination result is negative, the control unit 70 repeatedly executes the determination processing of Step S34 until the determination result of Step S34 becomes positive. On the other hand, if the determination result of Step S34 is positive, the control unit 70 determines that the sheet P has been completely fed onto the main transport path 28 from the sheet feed tray 21, and then completes the sheet transport processing routine.

In addition, if this sheet transport processing routine is completed, the control unit 70 determines, on the basis of a detection result of the printing start detecting sensor 29, whether or not the sheet P has been transported to a printing position directly below the nozzle formation surface 14 of the recording head 12. Then, if the determination result becomes positive, the rotation of the sheet gate roller pair 35 is stopped, and ink is ejected from the nozzles 13 of the recording head 12, thereby performing printing processing on the sheet P. In addition, since it is necessary to move the sheet P in the above X direction at the time of printing, the driving roller 24 rotates.

Figure 11:
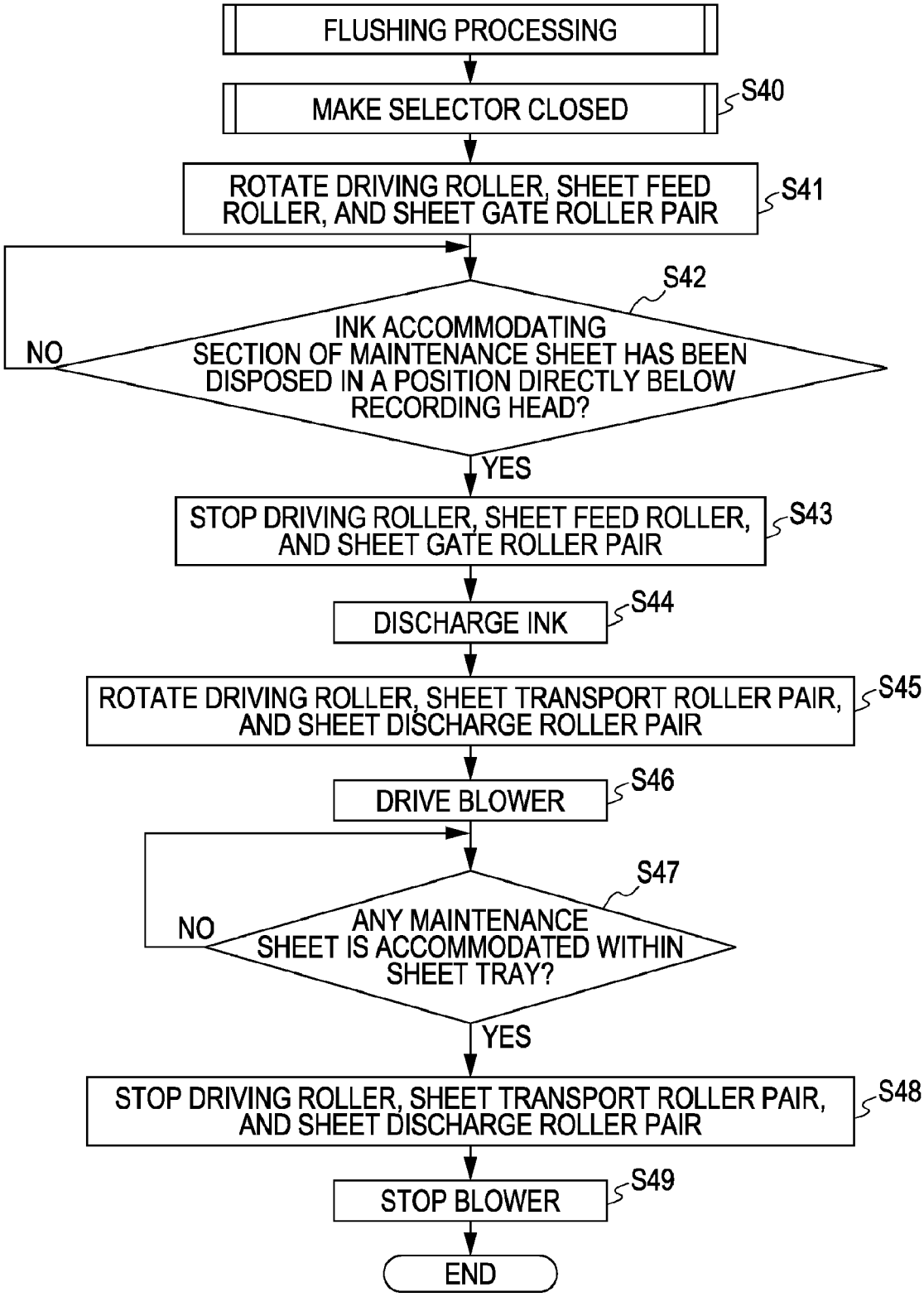

Next, the flushing processing (flushing processing routine) to be executed in Step S14 described above will be described below with reference to FIG. 11.

Now, in the flushing processing routine, the control unit 70 makes the selector 36 open (Step S40). Subsequently, the control unit 70 causes the driving roller 24, the sheet feed roller 43, and the sheet gate roller pair 45 to rotate (Step S41).

Then, the control unit 70 determines whether or not the ink accommodating section 55 (ink absorbing member 63) of the maintenance sheet 16 has been disposed in a position directly below the recording head 12 (Step S42). Specifically, the control unit 70 reads from the timer 74 the elapsed time after a maintenance sheet 16 transported from the sheet tray 41 is detected by the printing start detecting sensor 29 on the basis of the rotation of the driving roller 24, the sheet feed roller 43, and the sheet gate roller pair 45, and determines whether or not the read elapsed time (hereinafter referred to as "second elapsed time") has reached a second predetermined time or more. This second predetermined time is the time that is taken for the ink accommodating section 55 to move to a position directly below the recording head 12 after passage of a maintenance sheet 16 is detected on the basis of a signal from the printing start detecting sensor 29, and that is set in advance by experiment, simulation, etc. In addition, control is not made by the elapsed time from the point of time of detection of the printing start detecting sensor 29, but control may be made by determining whether or not the number of revolutions of a roller (for example, driving roller 24) from the point of time of detection of the printing start detecting sensor 29 has reached a predetermined number of revolutions.

If the determination result of Step S42 is negative (second elapsed time<second predetermined time), the control unit 70 determines that the ink accommodating section 55 has not yet been moved to a position directly below the recording head 12, and then repeatedly executes the determination processing of Step S42 until the determination result of Step S42 becomes positive. On the other hand, if the determination result of Step S42 is positive (second elapsed time≧second predetermined time) the control unit 70 determines that the ink accommodating section 55 has been moved to a position directly below the recording head 12, and then causes the rotation of the driving roller 24, the sheet feed roller 43, and the sheet gate roller pair 45 to stop (Step S43).

Subsequently, the control unit 70 causes ink to be independently discharged from each nozzle 13 of the recording head 12 (Step S44). That is, the control unit 70 causes flushing to be executed by the recording head 12. Then, the control unit 70 causes the driving roller 24, the sheet transport roller pair 48, and the sheet discharge roller pair 49 to rotate (Step S45), and causes the blower A to be driven (Step S46).

Subsequently, the control unit 70 determines whether or not any maintenance sheet 16 is accommodated within the sheet tray 41 (Step S47). Specifically, the control unit 70 reads from the timer 74 the elapsed time after the processing of Step S45 is executed, and then determines whether or not the read elapsed time (hereinafter referred to as "third elapsed time") has reached a third predetermined time or more. This third predetermined time is the time that is taken fro the maintenance sheet 16 in the facing position to be transported to the sheet tray 41 that is the non-facing position, and that is set in advance by experiment, simulation, etc.

If the determination result of Step S47 is negative (third elapsed time<third predetermined time), the control unit 70 determines that the maintenance sheet 16 has not yet been moved to a position directly below the sheet tray 41, and then repeatedly executes the determination processing of Step S47 until the determination result of Step S47 becomes positive. On the other hand, if the determination result of Step S47 is positive (third elapsed time≧third predetermined time), the control unit 70 causes the rotation of the driving roller 24, the sheet transport roller pair 48, and the sheet discharge roller pair 49 to stop (Step S48), and causes the driving of the blower A to stop (Step S49). Thereafter, the control unit 70 completes the flushing processing routine.

Next, the cleaning processing (cleaning processing routine) of Step S20 described above will be described below with reference to FIG. 12.

Now, in the cleaning processing routine, the control unit 70 causes the recording head moving mechanism 12*a* be driven, thereby causing the recording head 12 to descend, because the first cap section 53 of the maintenance sheet 16 has already been disposed in a position directly below the nozzle formation surface 14 of the recording head 12 (Step S50). That is, the control unit 70 causes the upper end 58*a* of the volume variable section 58 in the first cap section 53 to be displaced downward by the recording head 12. Subsequently, if the nozzle formation surface 14 of the recording head 12 has reached the lowermost position, the control unit 70 causes the driving direction of the recording head moving mechanism 12*a* to be stored, thereby causing the recording head 12 to ascend (Step S51).

Then, if the nozzle formation surface 14 of the recording head 12 has reached the uppermost position (position where the corresponding locking piece 59 is locked to the corresponding locking portion 60) while the state where it abuts on the upper end 58*a* of the volume variable section 58 in the first cap section 53 is maintained, the control unit 70 causes the driving direction of the recording head moving mechanism 12*a* to be reversed again. Then, the recording head 12 is caused to descend again by the reverse driving of the recording head moving mechanism 12*a* from this point of time (Step S52). Subsequently, after the nozzle formation surface 14 of the recording head 12 has been moved to the lowermost position while the state where it abuts on the upper end 58*a* of the volume variable section 58 in the first cap section 53 is maintained, the control unit 70 causes the recording head 12 to be moved in the direction opposite to the above Y direction by driving of the recording head moving mechanism 12*a* (Step S53).

Then, the control unit 70 causes the recording head 12 to ascend again by driving of the recording head moving mechanism 12*a* (Step S54). In addition, at this time, the recording head 12 ascends in a state where the sealed state within the volume variable section 58 is released, and with the ascent of the recording head, the upper end 58*a* of the volume variable section 58 also ascends in a state where it abuts on the nozzle formation surface 14. Then, as the corresponding locking piece 59 is locked to the corresponding locking portion 60 on the side of the sheet body 50 in the course of the ascent, the upper end 58*a* of the volume variable section 58 is restrained from ascending further. On the other hand, the recording head 12 ascends until the nozzle formation surface 14 separates from the upper end 58*a* of the volume variable section 58.

Subsequently, if the nozzle formation surface 14 separates from the upper end 58*a* of the volume variable section 58, the control unit 70 causes the recording head 12 to be moved in the above Y direction (right direction in FIG. 4) by driving of the recording head moving mechanism 12*a* by such distance that the recording head 12 has been moved in the direction opposite to the above Y direction in the processing of Step S23 (Step S55). Thereafter, the control unit 70 completes the cleaning processing routine.

Next, the wiping processing (wiping processing routine) of Step S21 described above will be described below with reference to FIG. 13.

Now, in the wiping processing routine, the control unit 70 causes the driving roller 24 to rotate (Step S61). That is, the maintenance sheet 16 is moved in the above X direction in a state where the tip 54*a* of the wiper section 54 is brought into sliding contact with the nozzle formation surface 14 of the recording head 12. Subsequently, the control unit 70 determines whether or not the ink accommodating section 55 (ink absorbing member 63) of the maintenance sheet 16 has been disposed in a position directly below the recording head 12 (Step S62). Specifically, the control unit 70 reads from the timer 74 the elapsed time after the driving roller 24 starts to rotate on the basis of the processing of Step S61, and then determines whether or not the read elapsed time (hereinafter referred to as "fourth elapsed time") has reached a fourth predetermined time or more. This fourth predetermined time is the time that is taken for the wiper section 54 to pass through a position directly below the recording head 12 from a state where the first cap section 53 has been disposed in the position directly below the recording head 12 and further for the accommodating section 55 to be disposed in the position directly below the recording head 12, and that is set in advance by experiment, simulation, etc. In addition, control is not made by the elapsed time after driving of the driving roller 24 is started, but control may be made by determining whether or not the number of revolutions of the driving roller 24 after the driving of the driving roller 24 is started has reached a predetermined number of revolutions.

If the determination result of Step S62 is negative (fourth elapsed time<fourth predetermined time), the control unit 70 repeatedly executes the determination processing of Step S62 until the determination result of Step S62 becomes positive. On the other hand, if the determination result of Step S62 is positive (fourth elapsed time≧fourth predetermined time), the control unit 70 causes the rotation of the driving roller 24 to stop (Step S63), and executes flushing for stabilizing a meniscus in each nozzle 13 (nozzle ink meniscus) after wiping of the nozzle formation surface 14. Thereafter, the control unit 70 completes the wiping processing routine. Then, before flushing is executed in this way, the control unit 70 may cause the recording head moving mechanism 12*a* to be driven to move the recording head 12 upward.

Next, the capping processing (capping processing routine) of Step S22 described above will be described below with reference to FIG. 14.

Now, in the capping processing routine, the control unit 70 causes the recording head moving mechanism 12*a* to be driven to move the recording head 12 upward (Step S70). That is, the control unit 70 causes the recording head 12 to be moved upward so that the distance (substantially "2 mm") from the facing surface 50*a* in the sheet body 50 of the maintenance sheet 16 to the nozzle formation surface 14 may become longer than the distance from the facing surface 50*a* to the tip 54*a* of the wiper section 54. Then, the control unit 70 causes the driving roller 24 to rotate in a direction opposite to the direction of rotation in Step S61 in the above wiping processing, thereby causing the maintenance sheet 16 to rotate in a direction opposite to the X direction on the main transport path 28 (Step S71). Subsequently, the control unit 70 determines whether or not the second cap section 52 of the maintenance sheet 16 has been disposed in a position directly below the recording head 12 (Step S72). Specifically, the control unit 70 reads from the timer 74 the elapsed time after the maintenance sheet 16 starts to move on the basis of the processing of Step S71, and then determines whether or not the read elapsed time (hereinafter referred to as "fifth elapsed time") has reached a fifth predetermined time or more. This fifth predetermined time is the time that is taken for the second cap section 52 to be located in a position directly below the recording head 12 by rotation of the driving roller 24 in the opposite direction from a state where the ink accommodating section 55 has been disposed in the position directly below the recording head 12, and that is set in advance by experiment, simulation, etc. In addition, control is not made by the elapsed time after driving of the driving roller 24 is started, but control may be made by determining whether or not the number of revolutions of the driving roller 24 after the driving of the driving roller 24 is started has reached a predetermined number of revolutions.

Then, if the determination result of Step S72 is negative (fifth elapsed time<fifth predetermined time) the control unit 70 determines that the second cap section 52 has not yet been moved to a position directly below the recording head 12, and then repeatedly executes the determination processing of Step S72 until the determination result of Step S72 becomes positive. On the other hand, if the determination result of Step 72 (fifth elapsed time≧fifth predetermined time) is positive, the control unit 70 causes the rotation of the driving roller 24 to stop (Step S73).

Subsequently, the control unit 70 causes the recording head moving mechanism 12*a* to be driven, thereby causing the recording head 12 to descend (Step S74). Then, the control unit 70 causes the recording head 12 to descend until the nozzle formation surface 14 of the recording head 12 abuts on the second cap section 52 to form a sealed space within the second cap section 52, and then causes the driving of the recording head moving mechanism 12*a* to stop, thereby completing the capping processing routine.

Next, among operations of the printer 10 of the present embodiment, an operation when maintenance processing is executed using the maintenance sheet 16 will mainly be described below. In addition, as the premise of description, the recording head 12 is wiped after cleaning has been executed, and subsequently, the nozzle formation surface 14 of the recording head 12 is capped by the second cap section 52.

Now, when cleaning is executed, first, a sheet transport path composed of the second guide plate 42, the main transport path 28, and the third guide plate 46 is formed by making the selector 36 closed (state shown by the broken line in FIG. 1). Next, the driving roller 24, the sheet feed roller 43, and the sheet gate roller pair 45 start to be driven. Then, a lowermost maintenance sheet 16 among maintenance sheets 16 accommodated in a stacked state in the sheet tray 41 in the non-facing position is taken out of the sheet tray 41, and this maintenance sheet 16 is transported via the second guide plate 42 to the main transport path 28.

At this time, since the supporting surface of each transport belt 23 is in a state of being charged by the charging roller 38, the maintenance sheet 16 is attracted onto and held by each transport belt 23. Then, when the maintenance sheet 16 is transported in the above X direction on each transport belt 23 (on the main transport path 28) until the first cap section 53 of the maintenance sheet 16 is disposed in a position directly below the recording head 12, the driving of the driving roller 24, the sheet feed roller 43, and the sheet gate roller pair 45 will be stopped.

Then, cleaning is executed. That is, with the result that the recording head 12 is caused to descend by driving of the recording head moving mechanism 12*a*, the nozzle formation surface 14 of the recording head 12 abuts on the upper end 58*a* of the volume variable section 58. At this time, the first cap section 53 (volume variable section 58) forms a sealed space between itself and the nozzle formation surfaces 14 of the recording head 12. Then, when the recording head 12 descends further, the upper end 58*a* of the volume variable section 58 is displaced downward and thereby the internal volume of the volume variable section 58 becomes small. Therefore, the pressure of the space (the above sealed space) within the volume variable section 58 becomes higher than that outside the volume variable section (outside the first cap section 53). As a result, when each normally closed valve 62 activates to open, and thereby the space within the volume variable section 58 and the outside thereof communicate with each other via each discharge hole 61.

Then, when the nozzle formation surface 14 of the recording head 12 is moved to the lowermost position, the recording head 12 stops to descend, and a pressure rise in the space within the volume variable section 58 stops. Therefore, each normally closed valve 62 operates to be closed, and thereby the space within the volume variable section 58 and the outside thereof are brought into a non-communication state. That is, the pressure within the volume variable section 58 becomes approximately equal to the external pressure. Then, the recording head 12 now starts to ascend by driving of the recording head moving mechanism 12*a*. At this time, the upper end 58*a* of the volume variable section 58 is displaced upward so as to follow the nozzle formation surface 14 on the basis of the elastic restoring force of the volume variable section 58 in a state where the abutment of the upper end on the nozzle formation surface 14 of the recording head 12 is maintained.

That is, the internal volume within the volume variable section 58 becomes gradually large, with the sealed space formed by the volume variable section 58 and the nozzle formation surface 14 maintained. Therefore, this leads to a negative pressure state where the pressure within the volume variable section 58 becomes lower than the external pressure (outside the first cap section 53). As a result, ink is sucked via each nozzle 13 from the recording head 12, and this sucked ink is discharged into the volume variable section 58. Then, when the height position of the upper end 58*a* of the volume variable section 58 has reached the above predetermined position, that is, when the recording head 12 has ascended to a height position where the corresponding locking piece 59 of the volume variable section 58 is locked to the corresponding locking portion 60 of the edge projection 51, the recording head moving mechanism 12*a* is driven reversely, and thereby the recording head 12 is caused to descend again.

Then, when the recording head 12 descends again by the reverse driving of the recording head moving mechanism 12*a* with the abutment between the nozzle formation surface 14 of the recording head 12 and the upper end 58*a* of the volume variable section 58 maintained, each normally closed valve 62 activates to open by further ascent of the recording head 12, and thereby the ink stored within the volume variable section 58 is discharged via each discharge hole 61. Then, the ink stored within the volume variable section 58 is recovered into the recovery section 18 disposed below the maintenance sheet 16 disposed in the facing position.

Thereafter, when the recording head 12 has moved to the lowermost position, the ascent of the recording head 12 is stopped, and the recording head 12 is moved in a direction opposite to the Y direction by driving of the recording head moving mechanism 12*a*. That is, the recording head 12 is moved in a direction opposite to the Y direction in a state where the upper end 58*a* of the volume variable section 58 and the nozzle formation surface 14 are brought into sliding contact with each other. As a result, the upper end of the volume variable section 58 is opened, and thereby the inside of the volume variable section 58 and the outside thereof are brought into a communication state. That is, the sealed state within the volume variable section 58 is released.

Then, the recording head 12 is caused to ascend by driving of the recording head moving mechanism 12*a*. At this time, since the inside of the volume variable section 58 and the outside thereof are brought into a communication state, there is no case that the pressure within the volume variable section 58 resulting from the ascent of the recording head 12 drops. Therefore, there is not case that suction acts on the recording head 12 due to a pressure drop in the volume variable section 58. That is, ink is not unnecessarily discharged from the recording head 12. Thereafter, when the nozzle formation surface 14 of the recording head 12 and the upper end 58*a* of the volume variable section 58 are separated from each other, the ascent of the recording head 12 is stopped, and the recording head 12 is moved in the Y direction. That is, the cleaning processing is completed. At this time, the distance from the facing surface 50*a* of the maintenance sheet 16 to the nozzle formation surface 14 of the recording head 12 is set to "about 0.5 mm."

Next, when the cleaning is completed, the driving roller 24 rotates, and thereby the maintenance sheet 16 is transported on the main transport path 28. At this time, the tip 54*a* of the wiper section 54 will be brought into sliding contact with the nozzle formation surface 14 of the recording head 12. Therefore, even if ink has adhered to the nozzle formation surface 14 at the time of cleaning, the nozzle formation surface 14 is wiped by the wiper section 54. That is, wiping of the nozzle formation surface 14 is executed.

Then, when the wiper section 54 passes through a position directly below the recording head 12 and the ink accommodating section 55 reaches the position directly below the recording head 12, ink is discharged towards the ink accommodating section 55 from each nozzle 13 of the recording head 12. That is, flushing is executed. Then, after completion of the flushing, the recording head 12 ascends and rotation of the driving roller 24 is reversed. Then, when the maintenance sheet 16 is moved towards in a direction opposite to the X direction (right direction in FIG. 1) and the second cap section 52 is disposed in a position directly below the recording head 12, the rotation of the driving roller 24 is stopped. At this time, since the distance from the facing surface 50*a* of the maintenance sheet 16 to the nozzle formation surface 14 of the recording head 12 is set to "about 2 mm," the wiper section 54 the projection height of which from the facing surface 50*a* is "about 1.5 mm" does not contact the recording head 12. Then, capping of the nozzle formation surface 14 of the recording head 12 is executed.

That is, with the result that the recording head 12 is caused to descend by driving of the recording head moving mechanism 12*a*, the nozzle formation surface 14 of the recording head 12 abuts on the upper end of the releasing projection 56. At this time, the second cap section 52 forms a sealed space between itself and the nozzle formation surface 14 of the recording head 12 to cap the nozzle formation surface 14.

In addition, since the second cap section 52 of the present embodiment is formed with the atmosphere release hole 57, a pressure change in the space (the above sealed space) within the second cap section 52 resulting from the temperature change of the ambient air (outside the second cap section 52) is suppressed. Accordingly, unlike a case where the atmosphere release hole 57 is not formed, a meniscus within each nozzle 13 of the recording head 12 is inhibited from being damaged by the pressure change of a space within the second cap section 52.

Thereafter, when a printing instruction is input to the control unit 70, the recording head 12 is caused to ascend by driving of the recording head moving mechanism 12*a*, and thereby the capping of the nozzle formation surface 14 is released. Next, rotation of the driving roller 24, the sheet transport roller pair 48, and the sheet discharge roller pair 49 is started. Then, the maintenance sheet 16 on the main transport path 28 is transported in the above X direction from the facing position, and is transferred to the third guide plate 46 from the other end side (left end side in FIG. 1) of the main transport path 28. Then, the maintenance sheet 16 on the third guide plate 46 is accommodated within the sheet tray 41 in a state where it is placed on each maintenance sheet 16 that is in a stacked state within the sheet tray 41.

Thereafter, the selector 36 is brought into a closed state (state shown by the solid line in FIG. 1), and consequently, a sheet transport path where the sheet feed tray 21 and the sheet discharge tray 22 are connected to each other via the first guide plate 31 and the main transport path 28 is formed. Then, when a sheet P is transported from the sheet feed tray 21 to a position directly below the recording head 12 in the main transport path 28, ink is discharged from the recording head 12, thereby starting printing.

Then, if the printing on one sheet P is completed, and any pages to print are still left, the sheet P that has been subjected to printing is transported to the sheet discharge tray 22, and thereafter the selector 36 is brought into an open state. Then, as the driving roller 24, the sheet feed roller 43, and the sheet gate roller pair 45 rotate, one maintenance sheet 16 is taken out of the sheet tray 41, and this maintenance sheet 16 is transported via the second guide plate 42 to the main transport path 28.

Then, when the ink accommodating section 55 of the maintenance sheet 16 has been disposed in a position directly below the recording head 12, the rotation of the driving roller 24, the sheet feed roller 43, and the sheet gate roller pair 45 is stopped. Next, ink is discharged towards the ink accommodating section 55 from each nozzle 13 of the recording head 12. That is, flushing by the recording head 12 is executed. Since the gap between the nozzle formation surface 14 of the recording head 12, and the upper end of the ink absorbing member 63 is set to such gap h that the discharged ink can be inhibited from being turned into mist, the ink discharged from each nozzle 13 is accommodated within the ink accommodating section 55 before being turned into mist.

Thereafter, rotation of the driving roller 24, the sheet transport roller pair 48, and the sheet discharge roller pair 49 is started. Then, the maintenance sheet 16 on the main transport path 28 is transported in the above X direction from the facing position, and is transferred to the third guide plate 46 from the other end side of the main transport path 28. At this time, hot air from the blower A is blown against the facing surface 50*a* of the sheet body 50 in the maintenance sheet 16. Therefore, most of the ink absorbed by the ink accommodating section 55 is evaporated by the hot air from the blower A. Thereafter, the maintenance sheet 16 is accommodated within the sheet tray 41, and printing on the next page is executed.

The present embodiment has the following advantages.

(1) The sheet body 50 of the maintenance sheet 16 is provided with the wiper section 54 for wiping the nozzle formation surface 14 of the recording head (liquid ejection head) 12 and the first cap section (cap section with a suction function) 53 for performing cleaning. Therefore, unlike a related-art maintenance sheet, it is not necessary to use a plurality of kinds of maintenance sheets selectively according to the kind of maintenance (cleaning, or the wiping of the nozzle formation surface 14) that is intended to execute. Accordingly, a plurality of kinds of maintenance in the recording head 12 can be efficiently executed with one maintenance sheet 16.

(2) It is presupposed that the projection height of the wiper section 54 from the facing surface 50*a* is smaller than the projection height of the first cap section 53 from the facing surface 50*a* in a case where the internal volume of the first cap section (section with a suction function) 53 reaches a maximum. Then, in this case, when the nozzle formation surface 14 is tried to wipe subsequent to cleaning, the nozzle formation surface 14 is wiped after the recording head 12 is moved downward (in a direction in which the nozzle formation surface 14 and the facing surface 40*a* are made to approach each other relatively). However, according to the present embodiment, wiping of the nozzle formation surface 14 is performed when a maintenance sheet 16 is transported in the X direction (transport direction) without moving the recording head 12 downward after cleaning using the first cap section 53 is completed. Accordingly, cleaning, and the wiping of the nozzle formation surface 14 can be performed continuously and efficiently.

(3) When a plurality of maintenance sheets 16 are accommodated in a stacked state within the sheet tray 41, the edge projection 51 of one maintenance sheet 16 will abut on another maintenance sheet 16. Therefore, for example, when maintenance sheets are accommodated in a stacked state, the wiper section 54 is inhibited from inadvertently abutting on another maintenance sheet 16, etc., and consequently, the wiper section 54 can be inhibited from being damaged. Further, when a maintenance sheet 16 is transported, the peripheral surface of each roller (sheet transport roller pair 48, etc.) that is located on the side of the facing surface 50*a* of the sheet body 50 abuts on only the edge projection 51 in the sheet body 50, and does not contact the cap sections 52 and 53, the wiper section 54, and the ink accommodating section 55. Thus, the peripheral surface of each roller can be inhibited from being soiled with ink.

(4) In the maintenance sheet 16 of the present embodiment, the ink (liquid) that is discharged (ejected) as a waste liquid from the recording head (liquid ejection head) 12 by flushing can be accommodated in the ink accommodating section (liquid accommodating section) 55. That is, the maintenance sheet 16 can cope with not only cleaning, and the wiping of the nozzle formation surface 14, but also flushing by the recording head 12.

(5) Before the ink (liquid) ejected as a waste liquid from the recording head (liquid ejection head) 12 at the time of flushing is turned into mist and scattered, it is accommodated with the ink accommodating section (liquid accommodating section) 55. That is, the ink accommodating section 55 can certainly accommodate the ink ejected as a waste liquid from the recording head 12 at the time of flushing.

(6) The first cap section (cap section with a suction function) 53 and the wiper section 54 are disposed so as to run along the transport direction of the maintenance sheet 16 in the sheet body 50. Therefore, when the maintenance sheet 16 is transported in the transport direction (X direction) after cleaning is executed by the first cap section 53, wiping of the nozzle formation surface 14 is performed by bringing the tip 54*a* of the wiper section 54 into sliding contact with the nozzle formation surface 14 of the recording head 12. Accordingly, cleaning, and the wiping of the nozzle formation surface 14 can be performed continuously and rapidly.

(7) The ink accommodating section (liquid accommodating section) 55 is disposed on the sheet body 50 so as to run along the first cap section (cap section with a suction function) 53 or the wiper section 54, and the transport direction (X direction) of the sheet body 50. That is, by moving the maintenance sheet 16 in the X direction (the above transport direction) in the facing position, the first cap section 53, the wiper section 54, or the ink accommodating section 55 can be disposed a position directly below the recording head 12. Further, since the ink accommodating section 55 is not disposed between the first cap section 53 and the wiper section 54, the ink accommodating section 55 can be inhibited from becoming a hindrance when cleaning, and the wiping of the nozzle formation surface 14 are performed continuously and rapidly.

(8) When the nozzle formation surface 14 of the recording head 12 has been moved in a direction away from the maintenance sheet 16 in a state where the nozzle formation surface 14 of the recording head (liquid ejection head) 12, and the volume variable section 58 of the first cap section 53 are brought into abutment with each other to form a sealed space within the volume variable section 58, the upper end 58*a* of the volume variable section 58 is biased towards the nozzle formation surface 14 by a side wall (biasing member) of the volume variable section 58. Therefore, even if the internal volume of the volume variable section 58 is increased, thereby making the pressure within the volume variable section 58 into a negative pressure state, the abutment between the volume variable section 58 and the nozzle formation surface 14 is maintained well. Accordingly, cleaning by the maintenance sheet 16 is certainly executed by securing the sealing performance of a sealed space formed by the volume variable section 58 and the nozzle formation surface 14.

(9) The second cap section (cap section with no a suction function) 52 is provided independently from the first cap section (cap section with a suction function) 53. Therefore, it is not necessary to performing cleaning, and it is possible to cap the nozzle formation surface 14 by the second cap section 52 when only capping of the nozzle formation surface 14 is tried to execute. On the other hand, when cleaning is performed, the first cap section 53 will be used. That is, since the first cap section 53 and the second cap section 52 can be used selectively if required, deterioration of the maintenance sheet (particularly the first cap section 53) 16 can be suppressed, unlike a case where only the first cap section 53 is provided.

(10) By using the maintenance sheet 16 provided with the first cap section 53 with a suction function in the printer (liquid ejecting apparatus) 10 including the sheet transport mechanism 17 and the recording head moving mechanism (relative movement mechanism) 12*a*, cleaning can be executed easily. Further, since it is not necessary to provide, for example, a cleaning mechanism having a suction pump, etc., the size of the printer 10 itself can be inhibited from increasing.

(11) By moving the recording head 12 in the vertical direction by driving of the recording head moving mechanism (relative movement mechanism) 12*a* in a state where the first cap section (cap section with a suction function) 53 is brought into abutment with the nozzle formation surface 14 of the recording head (liquid ejection head) 12, cleaning is executed. Accordingly, cleaning can be easily executed using the maintenance sheet 16.

(12) Further, since discharge of the ink from the volume variable section 58 is executed continuously with the discharge of the ink into the volume variable section 58 from the recording head 12, movement of the maintenance sheet 16 towards the sheet tray 41 from the facing position in a state where ink is stored within the volume variable section 58 is avoided. Therefore, unlike a case where a maintenance sheet 16 moves in a state where ink is stored within the volume variable section 58, the ink within the volume variable section 58 of the maintenance sheet 16 during movement can be inhibited from overflowing from the volume variable section 58, and thereby soiling the inside of the printer 10.

(13) When the volume variable section 58 of the first cap section (cap section with a suction function) 53 and the nozzle formation surface 14 of the recording head (liquid ejection head) 12 are brought into abutment into each other to form a sealed space within the volume variable section 58, the sealed state within the volume variable section 58 is released by the recording head moving mechanism (sealed state releasing mechanism) 12*a*. Thereafter, the facing surface 50*a* of the sheet body 50 in the maintenance sheet 16 and the nozzle formation surface 14 of the recording head 12 are separated from each other by the recording head moving mechanism (relative movement mechanism) 12*a*. Therefore, since the sealed state within the volume variable section 58 is already released when the recording head 12 is separated from the maintenance sheet 16, the suction by the first cap section 53 can be inhibited from inadvertently acting on the recording head 12. That is, cleaning can be inhibited from being executed inadvertently.

(14) When the maintenance sheet 16 has been disposed in the facing position, a portion where each discharge hole (communication hole) 61 is formed in the maintenance sheet 16 does not abut on each transport belt 23. Therefore, when ink (liquid) is discharged out of the first cap section 53 via each discharge hole 61 from the inside of the volume variable section 58 of the first cap section (cap section with a suction function) 53 by opening operation of each normally closed valve 62, the ink can be inhibited from adhering to each transport belt 23.

(15) Since a so-called full-line recording head (liquid ejection head) 12 is generally large-sized, it is difficult to move such a large-sized recording head 12 to a capping apparatus disposed in a non-printing region, and to perform various maintenance operations. In this regard, in the present embodiment, various kinds of maintenance can be easily performed in such a printer (liquid ejecting apparatus) 10 by transporting a maintenance sheet 16 to a facing position facing the recording head 12 by the sheet transport mechanism 17.

(16) Hot air from the blower A is blown against the facing surface 50*a* of the sheet body 50 in the maintenance sheet 16 transferred to the third guide plate 46. Therefore, most of adhering to the facing surface 50*a* of the maintenance sheet 16 will evaporate. Accordingly, when maintenance sheets 16 are accommodated within the sheet tray 41, ink can be inhibited from running down from one maintenance sheet 16, and consequently adhering to other maintenance sheets 16.

(17) Further, since most of the ink absorbed into the ink accommodating section 55 at the time of flushing by the recording head 12 is also evaporated by the hot air from the blower A, the absorption efficiency of the ink within the ink accommodating section 55 can be inhibited from being lowered when one maintenance sheet 16 is used multiple times.

The above embodiment may be modified as follows. When a maintenance sheet 16 in the facing position is transported to the sheet tray 41, the blower A may be driven necessarily.

The sheet transport mechanism 17 may be configured to have a plurality of transport belts 23 (for example, four) other than two belts. Even in this case, it is desirable that each transport belt 23 is disposed so as to abut on a position where each discharge hole 61 in a maintenance sheet 16 disposed in the facing position is not formed.

As the sealed state releasing mechanism, the sheet transport mechanism 17 that can move a maintenance sheet 16 disposed in the facing position in the X direction may be used if it can move the recording head 12 and the maintenance sheet 16 relative to each other in a direction that intersects the direction in which the facing surface 50*a* and the nozzle formation surface 14 approach and separate from each other. Even in such a configuration, even if the volume variable section 58 of the first cap section 53 and the nozzle formation surface 14 of the recording head 12 are brought into abutment into each other to form a sealed space within the volume variable section 58, the sealed state within the volume variable section 58 can be released by driving the sheet transport mechanism 17.

The sealed state releasing mechanism may be a drive mechanism that moves the whole sheet transport mechanism 17 in the Y direction and in a direction opposite to the Y direction.

The sealed state releasing mechanism may be a mechanism that forces at least one of the respective normally closed valves 62 to open in a state where the volume variable section 58 of the first cap section 53 and the nozzle formation surface 14 of the recording head 12 are brought into abutment into each other to form a sealed space within the volume variable section 58.

As the relative movement mechanism, an apparatus that can move the sheet transport mechanism 17 in the vertical direction may be used if it can move the facing surface 50*a* of the sheet body 50 in the maintenance sheet 16 disposed in the facing position and the nozzle formation surface 14 of the recording head 12 such that they approach and separate from each other. Further, the relative movement mechanism may be a mechanism composed of an apparatus that can move the sheet transport mechanism 17 in the vertical direction, and the recording head moving mechanism 12*a*.

The maintenance sheet 16 may has a configuration in which the second cap section 52 is not provided. In this case, the first cap section 53 will be used only when the nozzle formation surface 14 of the recording head 12 is capped.

As shown in FIG. 15, in order to protect the recording head 12, a head cover 80 may be attached to the recording head 12. If such a configuration is adopted, when the recording head 12 is moved in a direction opposite to the Y direction, thereby releasing the sealed state within the volume variable section 58 when the volume variable section 58 of the first cap section 53 and the nozzle formation surface 14 of the recording head 12 are brought into abutment with each other, the head cover 80 is able to bend the upper end 58*a* of the volume variable section 58 of the first cap section 53. As a result, a gap is formed between the nozzle formation surface 14 and the upper end 58*a*. Therefore, air flows into the volume variable section 58 from this gap, so that the sealed state within the volume variable section 56 can be released.

The communicating section, as shown in FIG. 16, may be a communicating groove 81 formed at the upper end of the releasing projection 56.

The volume variable section 58 may be made of a raw material that does not have an elastic restoring force. In this case, as shown in FIG. 17, it is preferable that the maintenance sheet 16 is provided with a spring 82 as a biasing member that biases the upper end 58*a* of the volume variable section 58 upward. In such a configuration, when the nozzle formation surface 14 and the volume variable section 58 are separated from each other in a state where the nozzle formation surface 14 of the recording head 12 and the volume variable section 58 of the first cap section 53 are brought into abutment with each other to form a sealed space within the volume variable section 58, the upper end 58*a* of the volume variable section 58 is biased towards the nozzle formation surface 14 (upward) by the spring 82. Thus, the abutment between the nozzle formation surface 14 and the volume variable section 58 is maintained well. Therefore, cleaning by the maintenance sheet 16 can be executed certainly.

The maintenance sheet 16 may has a configuration in which the ink accommodating section 55 is disposed between the first cap section 53 and the second cap section 52. Further, the ink accommodating section 55 may be disposed on the side of the transport direction (X direction in FIG. 2) than the first cap section 53.

The gap h between the upper end of the ink absorbing member 63 of the ink accommodating section 55 and the nozzle formation surface 14 of the recording head 12 is not limited to about 2 mm if it is a gap that can inhibit the ink discharged from the recording head 12 from being turned into mist. The maintenance sheet 16 may not be provided with the ink accommodating section 55.

In this case, it is desirable that, during flushing, ink is discharged as a waste liquid from the recording head 12 within the volume variable section 58 of the first cap section 53.

The wiper section 54 may be formed such that the projection height thereof from the facing surface 50*a* becomes larger than the projection height of the edge projection 51 from the facing surface 50*a*.

The maintenance sheet 16 may not be provided with the edge projection 51.

The maintenance sheet 16 may be a sheet in which a plurality of columnar edge projections 51 is provided at the edge of the facing surface 50*a*.

The wiper section 54 may be formed such that the projection height thereof from the facing surface 50*a* becomes smaller than the projection height of the first cap section 53 from the facing surface 50*a*.

The maintenance sheet 16 may not be provided with the wiper section 54. Even the maintenance sheet 16 having such a configuration can be used for cleaning or capping of the nozzle formation surface 14.

The sheet transport mechanism 16 may has a configuration any arbitrary number of discharge holes 61 other than three (for example, two) are formed.

Although the invention has been embodied as the ink jet printer 10 having the full-line recording head 12, the invention may be embodied in an ink jet printer of a type in which the recording head 12 is disposed in a carriage that reciprocates in a direction that intersects the transport direction of a sheet P.

Although the invention has been embodied in an ink jet printer in which ink is used for printing of sheets P as the liquid ejecting apparatus, the invention is not limited thereto, and may be embodied in liquid ejecting apparatuses that eject liquids other than ink. For example, the liquid ejecting apparatus may be a liquid ejecting apparatus that ejects a liquid material containing a material, such as an electrode material or a color material, that is used for manufacture of a liquid crystal display, EL (electroluminescent) display, a surface emission display, etc., in a dispersed or dissolved form, a liquid ejecting apparatus that ejects a living organic material used for manufacture of biochips, or a sample ejection apparatus as a precision pipette.

The entire disclosure of Japanese Patent Application Nos. 2006-156117, filed Jun. 5, 2006 and 2006-156118, filed Jun. 5, 2006 and 2007-111650, filed Apr. 20, 2007 and 2007-111651, filed Apr. 20, 2007 are expressly incorporated by reference herein.

What is claimed is:

1. A maintenance sheet with a facing surface facing a nozzle formation surface of a liquid ejection head provided in a liquid ejecting apparatus, the sheet comprising:

a cap section that is brought into an abutment state with the nozzle formation surface to form a sealed space in cooperation with the nozzle formation surface when the facing surface and the nozzle formation surface have been made to approach each other relatively in a facing position where the facing surface faces the nozzle formation surface, and wherein the cap section is made variable in internal volume in the abutment state;

a communication hole that is penetratingly formed so as to allow an inside and an outside of the cap section to communicate with each other; and a valve that opens and closes the communication hole, wherein the valve activates to open with a reduction in the internal volume of the cap section, while the valve activates to close with an increase in the internal volume of the cap section, further comprising a wiper section that wipes the nozzle formation surface when the facing surface and the nozzle formation surface have been moved relative to each other in a direction parallel to the nozzle formation surface in the facing position, wherein a projection is formed at the edge on the facing surface so as to surround the cap section and the wiper section, and the wiper section is formed such that a projection height thereof from the facing surface is smaller than a projection height of the projection from the facing surface.

2. The maintenance sheet according to claim 1, wherein the wiper section is formed such that the projection height thereof from the facing surface becomes larger than a projection height of the cap section from the facing surface in a case where the internal volume of the cap section reaches a maximum.

3. The maintenance sheet according to claim 1, further comprising a liquid accommodating section that accommodates liquid ejected as a waste liquid onto the facing surface from liquid ejection nozzles of the liquid ejection head in the facing position.

4. The maintenance sheet according to claim 3, wherein the cap section, the wiper section, and the liquid accommodating section are arranged so as to extend along a predetermined direction as a transport direction of the maintenance sheet on the facing surface, and such that the wiper section is located between the cap section and the liquid accommodating section.

5. The maintenance sheet according to claim 1, further comprising a biasing member that biases an opening end of the cap section open to the nozzle formation surface towards the nozzle formation surface so as to allow abutment of the nozzle formation surface on the cap section in the facing position.

6. The maintenance sheet according to claim 1, further comprising an separate cap section different from the cap section, and a communicating section that allows the inside and outside of the separate cap section to always communicate with each other, and the separate cap section is configured such that it is brought into abutment with the nozzle formation surface to form a sealed space in cooperation with the nozzle formation surface, when the facing surface and the nozzle formation surface have been made to approach each other relatively in the facing position.

7. A liquid ejecting apparatus comprising:

a liquid ejection head that ejects liquid to a target from liquid ejection nozzles;

a sheet transport mechanism that transports the maintenance sheet according to claim 1 to the facing position from a non-facing position where the facing surface does not face the nozzle formation surface of the liquid ejection head;

a relative movement mechanism that moves relative to at least one of the maintenance sheets transported to the facing position by the sheet transport mechanism and the liquid ejection head, in a direction in which the facing surface and the nozzle formation surface approach each other and separate from each other; and a control unit that controls the relative movement mechanism and the sheet transport mechanism.

8. The liquid ejecting apparatus according to claim 1, wherein the control unit controls the relative movement mechanism such that the internal volume of the cap section increases after the internal volume of the cap section decreases, when liquid is sucked from the liquid ejection nozzles into the cap section of the maintenance sheet in abutment with the nozzle formation surface of the liquid ejection head in the facing position.

9. The liquid ejecting apparatus according to claim 8, wherein the control unit controls the relative movement mechanism such that the internal volume of the cap section with the increased internal volume decreases, when liquid is discharged to the outside of the cap section after the liquid is sucked from the liquid ejection nozzles into the cap section of the maintenance sheet in abutment with the nozzle formation surface of the liquid ejection head in the facing position.

10. The liquid ejecting apparatus according to claim 8, further comprising a sealed state releasing mechanism that releases a sealed state within the cap section when the cap section and the nozzle formation surface have been brought into abutment with each other to form a sealed space within the cap section, wherein the control unit controls the sealed state releasing mechanism such that the internal volume of the cap section decreases when the cap section of the maintenance sheet in abutment with the nozzle formation surface of the liquid ejection head in the facing position is separated from the nozzle formation surface, then, the control unit controls the relative movement mechanism, thereby releasing the sealed state within the cap section, and then the control unit controls the relative movement mechanism such that the facing surface of the maintenance sheet, and the nozzle formation surface of the liquid ejection head are separated from each other.

11. The liquid ejecting apparatus according to claim 10, wherein the sealed state releasing mechanism moves relative to at least one of the maintenance sheets and the liquid ejection head in a direction that intersects the direction in which the facing surface and the nozzle formation surface approach each other and separate from each other, thereby releasing the sealed state within the cap section, in a state where the cap section and the nozzle formation surface are brought into sliding contact with each other.

12. The liquid ejecting apparatus according to claim 7, wherein the sheet transport mechanism includes a plurality of transport rollers and a plurality of belts hung between the transport rollers, and each of the belts is disposed so as to abut on a portion where the communication hole of the maintenance sheet transported to the facing position is not formed.

13. The liquid ejecting apparatus according to claim 7, wherein the liquid ejection nozzles are formed in the liquid ejection head over the overall width of the liquid ejection region of the target along the direction that intersects the transport direction of the target.

* * * * *